US008104244B2

(12) United States Patent
Pervan

(10) Patent No.: US 8,104,244 B2
(45) **Date of Patent: *Jan. 31, 2012**

(54) FLOORBOARDS, FLOORING SYSTEMS AND METHOD FOR MANUFACTURING AND INSTALLATION THEREOF

(75) Inventor: Darko Pervan, Viken (SE)

(73) Assignee: Valinge Innovation AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 11/822,717

(22) Filed: Jul. 9, 2007

(65) Prior Publication Data

US 2008/0168736 A1 Jul. 17, 2008

Related U.S. Application Data

(63) Continuation of application No. 10/730,131, filed on Dec. 9, 2003, now Pat. No. 7,739,849, which is a continuation of application No. PCT/SE03/00641, filed on Apr. 22, 2003.

(60) Provisional application No. 60/431,699, filed on Dec. 9, 2002.

(30) Foreign Application Priority Data

Apr. 22, 2002 (SE) ..... 0201225
Nov. 26, 2002 (SE) ..... 0203482

(51) Int. Cl.
*E04B 2/00* (2006.01)

(52) U.S. Cl. ..... 52/586.1; 52/588.1; 52/591.1

(58) Field of Classification Search ..... 52/588.1, 52/582.1, 586.1, 591.1, 591.5, 592.1, 578
See application file for complete search history.

(56) References Cited

U.S. PATENT DOCUMENTS

| | | | |
|---|---|---|---|
| 168,672 | A | 10/1875 | Reed |
| 1,723,306 | A | 8/1929 | Sipe |
| 1,743,492 | A | 1/1930 | Sipe |
| 1,787,027 | A | 12/1930 | Wasleff |
| 1,843,024 | A | 1/1932 | Fetzer |
| 1,925,070 | A | 8/1933 | Livezey |
| 2,015,813 | A | 10/1935 | Nielsen |
| 2,088,238 | A | 7/1937 | Greenway |

(Continued)

FOREIGN PATENT DOCUMENTS

CA 991373 6/1976

(Continued)

OTHER PUBLICATIONS

Patent Abstract of Japan, Publication No. 07300979, Toshiyuki et al.*

(Continued)

*Primary Examiner* — Basil Katcheves
(74) *Attorney, Agent, or Firm* — Buchanan Ingersoll & Rooney PC

(57) ABSTRACT

Floorboards with a format corresponding to a traditional parquet block for laying of mechanically joined floating flooring. Rectangular floorboards include a surface layer and a core with two long sides and two short sides, for making a floating flooring, which floorboards are mechanically lockable and which along their four sides have pairs of opposing connectors for locking similar, adjoining floorboards to each other both vertically and horizontally wherein the long sides have a length not exceeding 80 cm and the short sides have a width not exceeding 10 cm.

15 Claims, 14 Drawing Sheets

U.S. PATENT DOCUMENTS 2,089,075 A 8/1937 Siebs
2,303,745 A 12/1942 Karreman
2,430,200 A 11/1947 Wilson
2,497,837 A 2/1950 Nelson
2,740,167 A 4/1956 Rowley
3,259,417 A 7/1966 Chapman
3,377,931 A 4/1968 Hilton
3,436,888 A 4/1969 Ottosson
3,554,850 A 1/1971 Kuhle
3,694,983 A 10/1972 Couquet
3,916,965 A 11/1975 Attridge et al.
4,219,056 A 8/1980 Lindstrom
4,230,163 A 10/1980 Barton
4,281,696 A 8/1981 Howard et al.
4,426,820 A 1/1984 Terbrack et al.
4,512,131 A 4/1985 Laramore
4,599,841 A 7/1986 Haid
4,930,386 A 6/1990 Laskowski et al.
4,944,514 A 7/1990 Suiter
5,213,861 A 5/1993 Severson et al.
5,295,341 A 3/1994 Kajiwara
5,349,796 A 9/1994 Meyerson
5,425,986 A * 6/1995 Guyette ..... 428/141
5,744,220 A * 4/1998 Ringo ..... 428/195.1
5,899,251 A 5/1999 Turner
5,950,389 A 9/1999 Porter
5,954,915 A 9/1999 Voorhees et al.
6,006,486 A 12/1999 Moriau et al.
6,023,907 A 2/2000 Pervan
6,182,410 B1 2/2001 Pervan
6,189,283 B1 2/2001 Bentley et al.
6,216,409 B1 4/2001 Roy et al.
6,226,951 B1 5/2001 Azar
6,363,677 B1 4/2002 Chen et al.
6,418,683 B1 7/2002 Martensson et al.
6,421,970 B1 7/2002 Martensson et al.
6,536,178 B1 3/2003 Pålsson et al.
6,591,568 B1 7/2003 Paalsson
6,695,944 B2 2/2004 Courtney
6,711,869 B2 3/2004 Tychsen
6,729,091 B1 5/2004 Martensson
6,763,643 B1 7/2004 Mårtensson
6,769,218 B2 8/2004 Pervan
6,769,219 B2 8/2004 Schwitte et al.
6,851,237 B2 2/2005 Niese et al.
6,880,305 B2 4/2005 Pervan et al.
6,898,911 B2 5/2005 Kornfalt et al.
6,898,913 B2 5/2005 Pervan
6,918,220 B2 7/2005 Pervan
6,922,964 B2 8/2005 Pervan
6,922,965 B2 8/2005 Rosenthal et al.
6,955,020 B2 10/2005 Moriau et al.
6,966,963 B2 11/2005 O'Connor
7,040,068 B2 5/2006 Moriau et al.
7,051,486 B2 5/2006 Pervan
7,086,205 B2 8/2006 Pervan
D528,671 S 9/2006 Grafenauer
7,127,860 B2 10/2006 Pervan et al.
7,275,350 B2 10/2007 Pervan et al.
7,328,536 B2 2/2008 Moriau et al.
7,356,971 B2 4/2008 Pervan
7,377,081 B2 5/2008 Ruhdorfer
7,386,963 B2 6/2008 Pervan
7,398,625 B2 7/2008 Pervan
2002/0007608 A1 1/2002 Pervan
2002/0007609 A1 1/2002 Pervan
2002/0056245 A1 5/2002 Thiers
2002/0083673 A1 7/2002 Kettler et al.
2002/0092263 A1 7/2002 Schulte
2002/0095894 A1 7/2002 Pervan
2002/0112429 A1 8/2002 Niese et al.
2002/0112433 A1 8/2002 Pervan
2002/0170257 A1 11/2002 McLain et al.
2003/0024200 A1 2/2003 Moriau et al.
2003/0101674 A1 6/2003 Pervan et al.
2003/0196397 A1 10/2003 Niese et al.
2003/0196405 A1 10/2003 Pervan
2003/0221387 A1 12/2003 Shah
2004/0035079 A1 2/2004 Evjen
2004/0045254 A1 3/2004 Van der Heijden
2004/0068954 A1 4/2004 Martensson
2004/0139678 A1 7/2004 Pervan
2004/0177584 A1 9/2004 Pervan
2004/0211144 A1 10/2004 Stanchfield
2005/0055943 A1 3/2005 Pervan
2005/0108970 A1 5/2005 Liu
2005/0138881 A1 6/2005 Pervan
2005/0166502 A1 8/2005 Pervan et al.
2005/0193675 A1 9/2005 Smart et al.
2005/0208255 A1 9/2005 Pervan
2005/0210810 A1 9/2005 Pervan
2005/0268570 A2 12/2005 Pervan
2006/0075713 A1 4/2006 Pervan et al.
2006/0196139 A1 9/2006 Pervan et al.
2006/0283127 A1 12/2006 Pervan
2007/0011981 A1 1/2007 Eisermann
2007/0175143 A1 8/2007 Pervan et al.
2007/0175144 A1 8/2007 Hakansson
2007/0175148 A1 8/2007 Bergelin et al.
2007/0175156 A1 8/2007 Pervan et al.
2008/0000179 A1 1/2008 Pervan et al.
2008/0000180 A1 1/2008 Pervan
2008/0000182 A1 1/2008 Pervan
2008/0000186 A1 1/2008 Pervan et al.
2008/0000187 A1 1/2008 Pervan
2008/0000188 A1 1/2008 Pervan
2008/0000189 A1 1/2008 Pervan et al.
2008/0000194 A1 1/2008 Pervan et al.
2008/0000417 A1 1/2008 Pervan et al.
2008/0005989 A1 1/2008 Pervan et al.
2008/0005992 A1 1/2008 Pervan
2008/0005997 A1 1/2008 Pervan
2008/0005998 A1 1/2008 Pervan
2008/0005999 A1 1/2008 Pervan
2008/0008871 A1 1/2008 Pervan
2008/0010931 A1 1/2008 Pervan et al.
2008/0010937 A1 1/2008 Pervan et al.
2008/0028707 A1 2/2008 Pervan
2008/0028713 A1 2/2008 Pervan et al.
2008/0034701 A1 2/2008 Pervan
2008/0034708 A1 2/2008 Pervan
2008/0041007 A1 2/2008 Pervan et al.
2008/0041008 A1 2/2008 Pervan et al.
2008/0060308 A1 3/2008 Pervan
2008/0066415 A1 3/2008 Pervan et al.
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan et al.
2008/0168730 A1 7/2008 Pervan et al.
2008/0172971 A1 7/2008 Pervan
2008/0209837 A1* 9/2008 Pervan ..... 52/588.1
2008/0209838 A1 9/2008 Pervan

FOREIGN PATENT DOCUMENTS

DE 215 90 42 A1 6/1973
DE 33 43 601 A1 6/1985
DE 33 43 601 C2 6/1985
DE 296 18 318 U1 4/1997
DE 197 18 319 A1 11/1998
DE 197 18 812 A1 11/1998
EP 1 308 577 A2 5/2003
GB 812671 A 4/1959
JP 7-300979 A 11/1995
JP 7-310426 A 11/1995
JP 10-219975 A 8/1998
SE 450 141 B 6/1987
SE 506 254 C2 11/1997
WO WO 84/02155 6/1984
WO WO 94/26999 A1 11/1994
WO WO 97/47834 A1 12/1997
WO WO 98/38401 A1 9/1998
WO WO 99/66152 A1 12/1999
WO WO 00/20705 A1 4/2000
WO WO 00/66856 A1 11/2000
WO WO 01/02672 A1 1/2001

| | | | |
|---|---|---|---|
| WO | WO 01/66877 | A1 | 9/2001 |
| WO | WO 02/055809 | A1 | 7/2002 |
| WO | WO 02/055810 | A1 | 7/2002 |
| WO | WO 03/025307 | A1 | 3/2003 |
| WO | WO 03/89736 | A1 | 10/2003 |

OTHER PUBLICATIONS

Patent Abstract of Japan Publication No. 07300979, Konishi Toshiyuki et al, Nov. 14, 1995.*

Pervan, Darko, U.S. Appl. No. 12/941,760, entitled "Floorboard, System and Method for Forming a Flooring, and a Flooring Formed Thereof," filed in the U. S. Patent and Trademark Office on Nov. 8, 2010.

* cited by examiner

PRIOR ART

PRIOR ART

PRIOR ART

FLOORBOARDS, FLOORING SYSTEMS AND METHOD FOR MANUFACTURING AND INSTALLATION THEREOF

CROSS-REFERENCE TO RELATED APPLICATIONS

The present application is a continuation of U.S. patent application Ser. No. 10/730,131, filed Dec. 9, 2003, which is a continuation application of PCT/SE03/00641, filed on Apr. 22, 2003, and which claims the benefit of US Provisional Application No. 60/431,699, filed on Dec. 9, 2002, and the priority of SE 0201225-0 and SE 0203482-5. The contents of PCT/SE03/00641; SE 0201225-0; SE 0203482-5; and US Provisional Application No. 60/431,699 are hereby incorporated herein by reference.

FIELD OF THE INVENTION

The invention relates generally to the field of floorboards. The invention concerns floorboards which can be joined mechanically in different patterns so as to resemble traditional parquet flooring comprising blocks. The invention also relates to methods for laying and manufacturing floorboards. The invention is specifically suited for use in floating flooring which comprises floorboards having a surface of laminate and being joined by means of mechanical locking systems integrated with the floorboard, for instance of the kinds that are not wholly made of the core of the floorboard. However, the invention is also applicable to other similar floorboards which, for instance, have a surface layer of wood or plastic and which are joined in a floating manner by means of optional mechanical joint systems.

BACKGROUND OF THE INVENTION

The embodiments of the present invention are particularly suited for use in floating laminate flooring with mechanical joint systems. These types of flooring usually comprise a surface layer of laminate, a core and a balancing layer and are shaped as rectangular floorboards intended to be joined mechanically, i.e., without glue along both long sides and short sides vertically and horizontally.

The following description of prior-art technique, problems of known systems and objects and features of the invention will therefore, as non-limiting examples, be aimed at above all this field of application. However, it should be emphasized that the invention may also be used in optional floorboards which are intended to be joined in different patterns by means of a mechanical joint system. The invention may thus also be applicable to homogeneous wooden flooring and wooden flooring consisting of several layers, flooring with a core of wood fibers or plastic and with a surface which is printed or which consists of plastic, cork, needle felt and like material.

BACKGROUND ART

Parquet flooring was originally laid by laying blocks of suitable shape and size in different patterns and joining them by gluing to a sub-floor. Then the floor is usually ground to obtain an even floor surface and finished using, for instance, varnish or oil. Traditional parquet blocks according to this technology have no locking means at all, since they are fixed by gluing to the sub-floor. The main drawback of such a flooring is that it is very difficult to install. The main advantage is that the absence of locking means allows laying in complicated and attractive patterns.

According to another known method the blocks are formed with a groove along all edges round the block. When the blocks are then laid by gluing to the sub-floor, tongues are inserted into the grooves in the positions where required. This thus results in a floor where the blocks are locked vertically relative to each other by the tongue engaging in grooves of two adjoining blocks. The surface becomes smooth and the blocks can thus be delivered with a completed varnished surface. The horizontal joint is obtained by nailing or gluing to the sub-floor.

Traditional parquet blocks are rectangular and usually have a size of about 7*40 cm. The advantage of the above flooring is that the blocks can be laid in attractive patterns, for instance, in parallel rows with the short sides offset relative to each other, in diamond pattern or in herringbone pattern where the blocks are joined long side to short side. The drawback of such flooring is above all that laying and manufacture are complicated and expensive. Such flooring cannot move relative to the sub-floor. As the blocks shrink and swell owing to changes in relative humidity (RH), undesirable joint gaps arise between the blocks.

In order to solve these problems, first the floating wooden flooring was developed. Such flooring comprises considerably larger floorboards with a width of for instance 20 cm and a length of 120-240 cm. The surface consists as a rule of parquet blocks which are joined in parallel rows. Such floorboards facilitate installation since a plurality of blocks can be joined simultaneously. The main drawback is that it is not possible to provide advanced patterns. Later, floating laminate flooring was developed, which basically was a copy of the floating wooden flooring except that the decorative surface layer consisted of a printed and impregnated sheet of paper that was laminated to a wood fiber core. Such a floorboard was less expensive than a wooden floor and had a more wear and impact resistant surface. Floating floorboards of this type are joined only at their joint edges, i.e., without gluing, on an existing sub-floor which does not have to be quite smooth or plane. Any irregularities are eliminated by means of underlay material in the form of, for instance, hardboard, cork or foam. They may thus move freely on the sub-floor. In case of changes in relative humidity, the entire floor swells and shrinks. The advantage of floating flooring with a surface of, e.g., wood or laminate is that the joints between the floorboards are tight and the change in size takes place hidden under the baseboards. Such floorboards have a significantly larger surface than the blocks, which enables quicker laying and rational production. Traditional such floating laminate and wooden floorings are usually joined by means of glued tongue-and-groove joints (i.e., joints with a tongue on one floorboard and a tongue groove on the adjoining floorboard) on long side and short side. In laying, the boards are brought together horizontally, a projecting tongue along the joint edge of one floorboard being inserted into a tongue groove along the joint edge of an adjoining board. The same method is used on long side and short side, and the boards are as a rule laid in parallel rows long side against long side and short side against short side.

In addition to such traditional floating flooring which is joined by means of glued tongue-and-groove joints, floorboards have been developed in recent years, which do not require the use of glue but are instead joined mechanically by means of mechanical locking systems. These systems contain locking means which lock the boards horizontally and vertically. The mechanical locking systems can be formed in one piece with the floorboard, e.g., by machining a part of the core of the floorboard. Alternatively, parts of the locking system can be made of a separate material which is integrated with the floorboard, i.e., joined with the floorboard even in the manufacture thereof at the factory. The floorboards are joined, i.e., interconnected or locked together, by different combinations of angling, snapping-in and insertion along the joint edge in the locked position. The floorboards are joined successively, i.e., the preceding floorboard is connected to another floorboard on one long side and one short side when a new floorboard is joined with the preceding one.

The main advantages of floating floorings with mechanical locking systems are that they can be laid still more easily and quickly and with great accuracy by different combinations of inward angling and/or snapping in. In contrast to glued floors, they can also easily be taken up again and reused in another place.

Definition Of Some Terms

In the following text, the visible surface of the installed floorboard is called "front side", while the opposite side of the floorboard, facing the sub-floor, is called "rear side". The sheet-shaped starting material that is used in manufacture is called "core". When the core is coated with a surface layer closest to the front side and generally also a balancing layer closest to the rear side, it forms a semimanufacture which is called "floor panel" or "floor element" in the case where the semimanufacture, in a subsequent operation, is divided into a plurality of floor panels mentioned above. When the floor panels are machined along their edges so as to obtain their final shape with the joint system, they are called "floorboards". By "surface layer" are meant all layers applied to the core closest to the front side and covering typically the entire front side of the floorboard. By "decorative surface" is meant a layer which is mainly intended to give the floor its decorative appearance. "wear layer" relates to a layer which is mainly adapted to improve the durability of the front side. By "laminate flooring" is meant a floorboard with a surface layer of a thermosetting laminate comprising one or more paper sheets impregnated with a thermosetting resin. The wear layer of the laminate flooring comprises, as a rule, a transparent sheet of paper with aluminum oxide added, impregnated with melamine resin. The decorative layer comprises a melamine impregnated decorative sheet of paper. The outer parts of the floorboard at the edge of the floorboard between the front side and the rear side are called "joint edge". As a rule, the joint edge has several "joint surface" which can be vertical, horizontal, angled, rounded, beveled, etc. These joint surfaces exist on different materials, for instance laminate, fiberboard, wood, plastic, metal (especially aluminum) or sealing material. By "joint" or "locking system" are meant co-acting connecting means which connect the floor-boards vertically and/or horizontally. By "mechanical locking system" is meant that joining can take place without glue horizontally parallel to the surface and vertically perpendicular to the surface. Mechanical locking systems can in many cases also be joined by means of glue. By "integrated" means that the locking system could be made in one piece with the floorboard or of a separate material which is factory-connected to the floorboard. By "floating floor" is meant flooring with floorboards which are only joined with their respective joint edges and thus not glued to the sub-floor. In case of movement due to moisture, the joint remains tight. Movement due to moisture takes place in the outer areas of the floor along the walls hidden under the baseboards. By "parquet block" is meant a rectangular floorboard having the shape of a traditional parquet block or strip. The most common format is about 40*7 cm. However, the parquet block may also have a length of 15-80 cm and a width of 4-10 cm. By "floor unit" are meant several floorboards which are joined and which constitute part of the flooring. By "length" and "width" of the floorboard are generally meant the length and width of the front side.

Discussion Of Related Art

The size of a floorboard is to a considerable extent related to the material of the floorboard, the machining of the edges, the type of locking system and the installation of the floorboards.

It is generally an advantage to produce a floorboard of solid wood in a small size since defects such as cracks, knots, etc. can be cut out and the wood raw material can be used more efficiently.

It is, however, an advantage to produce most other types of floorboards, especially laminate floorings, in large sizes since this gives a better utilization of the raw material and lower production costs. This is especially favorable when the floorboards are produced from large floor panels with an artificial surface, which is for instance printed. In such a case, it is of course an advantage to reduce the saw cuts as much as possible.

The machining of the joint edges to form floorboards is an expensive operation in all types of floor materials. It is known that a floor comprising large-sized panels with few joints has a considerable cost advantage against a floor which comprises many small-sized panels. It is also known that small sizes of floor panels would cause disadvantages in a floor, especially in a floor where the floorboards are rectangular and narrow, thus having a large amount of joints at the long sides of the narrow panels.

It is known that small-sized floorboards with mechanical locking systems would be more expensive to produce than similar panels with traditional tongue and groove systems. It is also known that mechanical locking systems, which enable a high quality locking with angling, due to the larger amount of material required for forming the locking system, are generally more costly and complicated to machine than the more compact snap systems. Mechanical locking systems of any kind on the long sides of a rectangular panel are in general more costly to produce than any type of mechanical locking system on the short sides.

In general, a floor which comprises large panels can be installed faster than a floor which comprises small floor panels.

WO01/66877 discloses a system for providing a patterned flooring comprising laminate floorboards. Two embodiments are disclosed: a first one (FIG. 4*a*, 4*b*) where an integrated locking system is used, and a second one (FIG. 5 and FIG. 6,) where a separate joining profile is used. The floorboards are locked by a vertical non-releasable snapping only. In the first, integrated embodiment, two different types of floorboards, termed ≅male≅ and ≅female≅, are required. Installation with vertical snapping is complicated and there is a considerable risk that the edges or part of the locking system is damaged during locking or unlocking. Furthermore, WO01/66877 is aimed at floorboards having a size of 1200 mm by 200 mm.

WO00/20705 discloses a system for locking together laminate floorboards by means of a separate joining profile, which is connected to the floorboards when they are being installed. The joining profile is adapted for locking together the floorboards by non-releasable snapping only. A specific objective of WO00/20705 is to decrease the amount of material waste in connection with production of the floorboards, and especially in connection with the forming of the mechanical locking system.

DE 197 18 319 C2 discloses a solid wood parquet strip having a locking system along its long and short edges, for locking together the parquet strip with other parquet strips in connection with laying. Gluing the parquet strips is, however, necessary, and the purpose of the mechanical locking is to keep the floorboards together while the glue cures. The mechanical locking is only provided in a horizontal direction. The parquet strips are stated to have a length of 250-1000 mm and a width of 45-80 mm.

To facilitate the understanding and the description of the present invention as well as the knowledge of the problems behind the invention, a more detailed description of these specific size-related features and prior-art technique now follows with reference to FIGS. 1-3 in the accompanying drawings.

The major part of all floating laminate floors (FIG. 1*a*) comprises rectangular floorboards 1 with a length 4*a* of about 120 cm and a width 5*a* of about 20 cm. By means of modern printing technology, laminate flooring can be manufactured which in terms of appearance are very true copies of various natural materials such as wood and stone. The most common pattern is an imitation of parquet flooring comprising blocks 40. These blocks usually have a width of about 7 cm and a length of 20-40 cm. As a rule, the floorboard contains three rows of parallel blocks whose short sides are offset relative to each other. This means that at least one block 41 at the short side 5*a*, 5*b* of the floorboard will be shorter than the other two blocks. When the floorboards are joined (FIG. 1*b*), the result will be an unnatural appearance compared with a real traditional parquet floor consisting of blocks of equal length, with their short sides offset. The same applies to floating wooden flooring.

A further problem which causes an unnatural appearance is related to the manufacturing technology. This is shown in FIG. 2. Laminate flooring is manufactured by a printed decorative sheet of paper being impregnated with melamine resin and laminated to a wood fiber core so that a floor element 2 is formed. The floor element 2 is then sawn into, for instance, some ten floor panels 3 which are machined along their edges to floorboards 1. The machining along the edges is carried out by the long sides 4*a*, 4*b* of the panels first being machined in a machine 101, after which they are moved to another machine 105 which machines the short sides. In connection with impregnating, the decorative paper swells in an uncontrolled manner. The swelling and the manufacturing tolerances arising in connection with laminating, sawing and machining along the edges result in the position of the blocks in different floorboards deviating from the desired position. When two floorboards are joined with their short sides against each other, the blocks 41*a*, 41*b* may be laterally offset and their length may vary significantly (FIG. 1*c*). All these circumstances cause great manufacturing problems in connection with manufacture of laminate flooring with a 3-block parquet pattern.

In order to solve these problems, a number of expensive methods have been used to control the manufacturing process when making laminate flooring. The most common method is that the production is controlled using advanced cameras which automatically measure and position the semi-manufactures during the manufacturing process. Different patterns are also made by special displacements of the blocks so that the position defects are concealed as much as possible. In wooden flooring, blocks of varying length and parallel displacement are used to conceal the cut-off blocks on the short side. All prior-art methods give an unsatisfactory result. Floating flooring could reach a larger market if natural parquet patterns could be provided in combination with rational production and laying.

FIGS. 3*a*-3*d* show examples of mechanical locking systems which are used in floating flooring. All these systems cause waste W. This waste arises in connection with sawing (SB) and in connection with machining of the mechanical connecting means. To minimize this waste W, the manufacturer strives to make the floorboards as large as possible and with as few joints as possible. Therefore, the floorboards should be wide and long. Narrow floorboards contain many joints per square meter of floor surface. Such narrow laminate floorboards with a width and length corresponding to a traditional parquet block are not known. The narrowest laminate floorboards have a width exceeding 15 cm and a length exceeding 100 cm. FIG. 3*e* shows connection by inward angling and FIG. 3*f* shows connection by snapping-in of two adjacent sides 1, 1=of two floorboards.

OBJECTS AND SUMMARY

An object of the present invention is to provide floorboards which can be joined mechanically to a floating flooring with a natural parquet pattern which in terms of appearance corresponds to traditional parquet blocks. A further object is to provide suitable joint systems, laying methods and laying patterns for these floorboards.

Modern production technology and mechanical joint systems in combination with special laying methods make it possible to join very small floorboards quickly and with extremely great accuracy. A surprising result is that flooring which comprises small floorboards can be installed almost as quickly and with the same quality as traditional flooring comprising considerably larger floorboards. It is also possible to provide an installation which is quicker and gives a better result than large floorboards with mechanical joint systems. The reason is that we have discovered that small floorboards are easier to handle, the frictional surfaces along the long sides of the joint portions will be smaller, which facilitates displacement, and finally snapping-in of the short side can take place with lower force since the parts that are bent in connection with snapping-in are smaller and afford less resistance. An additional advantage is that the short side of narrow floorboards could be produced with a locking system, which only locks horizontally and which do not require a vertical snap. Such a locking system could be accomplished by, for example, removing the tongue 22 on the short side of a rectangular floorboard with a locking system similar to FIG. 3*b*. The narrow short sides (5*a*, 5*b*) of two locked floorboards will nevertheless be held in the desired vertical position by the locked long sides (4*a*, 4*b*), in a floor where the floorboards are installed in parallel rows with offset short sides (see FIGS. 9*f*, 4*a*-4*d*). Such a floor could be installed very easy, since the installation only requires an angling of the long sides. Floorboards could be produced with an angling locking system on long side and without any locking system on the short side at all. The short sides could be kept together by the friction of the long sides or by gluing and/or nailing down the floorboards to the sub-floor. Such narrow short sides could be installed faster but with the same high quality as wide short sides. Conversely, wider short sides, without any vertical locking system, would increase the risk of the short sides becoming warped, thus creating an uneven floor.

The production cost for small floorboards with mechanical joint systems need not necessarily be higher than for large floorboards. Small floorboards certainly contain essentially more joints per square meter of floor than large floorboards and the machining cost as well as the amount of waste are great when using the prior-art mechanical joint systems. However, these problems can largely be avoided if the floorboards are produced and if joint systems are formed according to the invention. Small floorboards imply that a larger amount of the raw material of wood can be utilized since it is easier to make small blocks without knots and defects than it is in the manufacture of large boards. The format of the floorboard and its location in the floor can also be used to create in a cost-efficient manner the decorative appearance of a floor which is made by sawing a floor element, for instance a laminate floor. By sawing, for example, a floor element in the format 2.1*2.6 m with a printed veneer pattern, some hundred floorboards can be manufactured. Such small floorboards, which can have the shape of a parquet block, can be joined in different patterns with different laying directions. Then a parquet pattern of blocks can be created, which cannot be manufactured using today=s technique. The swelling problems of the decorative paper are eliminated, and accurate positioning and pattern alignment in connection with sawing are not necessary. This reduces the production cost. If the floorboards are narrow, any angular errors between long side and short side will be less visible in a narrow floorboard than in a wide.

It is possible and even advantageous in floating flooring to use small floorboards with a format corresponding to, for instance, traditional blocks. Such a floating flooring will consist of essentially more joints than a traditional flooring consisting of large boards. The great amount of joints per unit area reduces the movement of the floor along the walls since each joint has a certain degree of flexibility. A laminate flooring moves for instance about 1 mm per meter as relative humidity varies over the year. If the floorboards have, for instance, a width of 66 mm, each meter will contain 15 joints. A shrinkage will then result in a maximum joint gap between two adjacent top edges of two floorboards of 0.06 mm, provided that the floor owing to load is prevented from moving. Such a joint gap is invisible. This joint gap should be adapted to the floor type. In laminate floors a joint gap of 0.01B0.1 or somewhat larger could be sufficient. In a solid wood floor made of oak, a joint gap could be in the order of 0.1-0.2 mm. It may be an advantage if such a joint gap could be combined with a bevel at the upper adjacent edges, which in dry conditions hides the opening. Floating flooring comprising small floorboards can thus be laid in larger spaces especially if they are produced with a locking system which allows at least some horizontal movement along and/or towards the joint edges in locked position. Such a floor will, in fact, behave as a semi-floating floor which utilizes both the movement of the whole floor and movement within the locking system to counteract changes in humidity.

Narrow floorboards will be considerably less curved than wide floorboards as RH varies. This results in a planer floor and easier installation.

A flooring comprising many small floorboards gives better possibilities of providing a high laying quality with invisible joint gaps. Laminate and wooden flooring can, owing to an uneven moisture ratio in the board, be laterally curved. Such a Abanana shape≅ may cause visible joint gaps. If the length of the boards is reduced, for instance, from 1200 mm to 400 mm, the joint gap will be reduced significantly. Narrow boards are also easier to bend, and in practice the mechanical locking system will automatically pull the boards together and completely eliminate the banana shape.

The moisture problems that often arise in gluing of wood blocks to a concrete floor can be solved by the wood block being joined in a floating manner so that a moisture barrier of plastic can be arranged between the wooden floor and the concrete.

A very convenient method of creating a natural parquet pattern comprising wood blocks displaced in parallel, is that the floorboards are made narrow with a width and typically also with a length corresponding to a parquet block.

It is possible to provide a floor system which, for instance, comprises small floorboards with preferably the same width and preferably different lengths where the length can be an even multiple of the width, and in which floor system floorboards have mirror-inverted mechanical locking systems. Such a floor system enables laying in all the advanced patterns that can be provided with traditional parquet blocks. Laying can take place considerably more quickly and with better accuracy. Such a floor system can produce advanced patterns also with a surface layer which in traditional use can only be used in a few variants. A surface layer of needle felt or linoleum can, for instance, be glued to an HDF board. If such floor elements are manufactured in different color variants and are machined to a floor system according to the invention, joining of different floorboards in different colors can give highly varying and advanced patterns which cannot be provided with the original surface layer.

A short side of a narrow floorboard must be able to withstand the same load as a significantly longer short side of a traditional floating floor. The reason is that a point load on an individual row can be the same. For instance, an 85 mm short side of a floor according to the invention, should preferably be able to withstand the same load as a 200 mm short side of a traditional floor. The short side should suitably have a strength that withstands a tensile load of 100 kg or more. Joint systems that are laid by downward angling of the short side, displacement along the joint edge and downward angling of the long side are particularly convenient for narrow boards. The reason is that a joint system which is joined by angling can be made stronger than a joint system which is joined by snap action. The floorboards according to the invention may have joint systems on long side and short side which can be joined by downward angling.

Thus, the above means that according to the invention it is possible to provide small floorboards, with a format corresponding to traditional parquet blocks, which, in a surprising manner and contrary to what has been considered possible till now, may contribute to giving advantages in floating flooring. These advantages significantly exceed the known drawbacks.

The principles as described above can be applied to floor systems having other formats than traditional parquet blocks. For example, stone reproductions can be made in the formats 200*400 mm, 200*600 mm etc with mirror-inverted joint systems which can be joined by angling and/or snap action. These formats can be joined in advanced patterns as stated above long side against long side, short side against short side or long side against short side.

Thus, according to a first embodiment of the invention, there is provided a rectangular floorboard for providing a patterned floating flooring, said floorboard being provided, at least along opposing long edges, with integrated connectors for locking together said floorboard with a second floorboard, such that upper edge portions of said floorboard and said second floorboard, in a joined state, together define a vertical plane. The connectors are adapted for locking together said floorboard and said second floorboard in a horizontal direction, perpendicular to said vertical plane, and the connectors are adapted for locking together said floorboard and said second floorboard in a vertical direction, perpendicular to a main plane of said floorboard. The floorboard is distinguished in that a long edge of said floorboard has a length not exceeding 80 cm and a short edge of said floorboard (1) has a length not exceeding 10 cm.

A flooring composed of such small floorboards will provide an improved imitation of a classically patterned parquet flooring, since the joints will be consistent with the parquet blocks and not exhibit any pattern offsets or Aadditional≅ joints such as are exhibited by known parquet and laminate floor boards. Thus, compared with known parquet floorboards, the problem of two adjacent floorboards having mutually non-matching patterns will be eliminated. Due to the integrated mechanical locking system, the floorboards are easier to install than floorboards for a classical parquet flooring.

According to one embodiment, the connectors may be adapted for locking together said floorboard and said second floorboard at least by means of inward angling, whereby upper joint edges contact each other. The ability of the connectors to allow for a connection by an angling operation is advantageous since a joint system which is joined by angling can be made stronger and easier to install than a joint system which is joined by a snap action.

According to another embodiment, the connectors may be adapted for releasing said floorboard and said second floorboard by means of upward angling, away from a sub-floor. Such releasing or unlocking of the floorboards facilitates laying, adjustment, replacement and reuse of the floorboards.

According to another embodiment, the second floorboard may be substantially identical with said floorboard. Thus, only one type of floorboard needs to be produced in order to provide the flooring.

According to another embodiment, the floorboard may have a surface layer comprising a thermosetting resin. By providing the floorboard with such a laminate surface, it is possible to increase its wear resistance as compared with the wood surface of strips for classically patterned parquet floors.

According to another embodiment, the floorboard may have a surface layer comprising wood or wood veneer. A surface layer of wood or wood veneer will provide the appearance and feel of a real wood parquet floor, while reducing the cost as compared with traditional parquet floors. Thus, the floorboard core may be of any known core material, such as wood slates, HDF, MDF, particle board, plywood etc.

According to another embodiment, the connecting means may comprise a separate part, which projects from the joint edge and which is mechanically joined with a core of the floorboard. Such a separate part may be utilized to instead of removing material from the edge of the floorboard, thus reducing the amount of material waste.

According to another embodiment, the surface of the floorboard may have a decoration and a shape corresponding to a traditional parquet block with a length of 30-80 cm and a width of 5-10 cm.

According to another embodiment, the joint edges opposing each other in pairs on the long edges of the floorboards may comprise a projecting locking element integrated with the floorboard, and in that the opposing second edge portion in the same pair comprises a locking groove for receiving the locking element of an adjoining floorboard.

According to another embodiment, a long edge of said floorboard may have a length exceeding 15 cm and a short edge of said floorboard has a length exceeding 4 cm.

According to a second aspect of the invention, there is provided a patterned floating flooring, a pattern of which being provided by respective shapes of floorboards constituting said patterned floating flooring. The flooring is distinguished in that the patterned floating flooring comprises the floorboards as described above.

According to a third aspect of the invention, there is provided a block of floorboards for providing a floating flooring. The block of floorboards is distinguished in that said block comprises at least two floorboards as described above and in that these at least two floorboards are arranged such that at least one short edge of a first of the at least two floorboards is aligned with at least one short edge of a second of the at least two floorboards.

Several variants of the invention are feasible. The floorboards can be provided with all prior-art mechanical joint systems. Special floorboards can be manufactured, comprising, for instance, 9 floorboards according to the invention which are joined in three rows displaced in parallel. The short sides are thus not straight but comprise displaced rows. Such floorboards can be laid by a combination of downward angling of the long side, lateral displacement and snapping-in of the short side. The other embodiments can also be laid by inward angling of the short side, lateral displacement and downward angling. Finally, also different combinations of snapping-in or insertion along the joint edge of a long side or short side, lateral displacement and snapping-in of another long side or short side can be used.

According to a fourth aspect of the invention, there is provided a method for manufacturing a rectangular floorboard, having long edges and short edges, said long edges being provided with a locking system comprising integrated connecting means for locking together said floorboard with a second floorboard. The method comprises steps of linearly displacing relative to each other a floor element, sized and adapted for providing at least two floor panels and a set of tools for machining a first pair of opposing edge portions of the floor element, to provide a final shape of at least part of said short edges of said floorboard, dividing the floor element into said at least two floor panels, and linearly displacing, relative to each other, one of said at least two floor panels and a set of tools for machining a second pair of opposing edge portions of said floor panel, to provide at least part of said locking system. The above described production method is particularly suitable for manufacturing small floorboards, such as the ones described above.

This method enables rational manufacture of small floorboards. Both the first and the second step can be performed in the same production line. If the floorboards have the same locking systems on long side and short side, the same set of tools can be used for both long side and short side. Mirror-inverted A and B boards can be made by the short side panel before sawing being turned through 180 degrees.

Fifth and sixth aspects of the present invention provide respective flooring systems which comprise floorboards with the same width but different lengths which can be a multiple of the width. According to one embodiment, the floorboards have mirror-inverted joint systems which can be joined by inward angling. They can be laid in many different patterns with long sides joined with short sides. According to a different embodiment there may be four different types of floorboards, differing from each other with respect to length and/or orientation of the locking system (normal B mirrored).

Seventh and eight aspects of the invention provide alternative methods for installing a flooring using floorboards as described above. Using one of these methods, quick and effective laying of a floor according to the present invention can be carried out. According to one alternative, the floorboard is joined at an angle with the locking means in contact with each other, but in a position that deviates from the final position when the floorboards are lying flat on the sub-floor.

The floorboard is then displaced a distance corresponding to its entire length relative to another floorboard in the preceding row before the final locking takes place.

The above manufacturing and laying technique is particularly suited for small floorboards, but may, of course, advantageously also be used in floorboards with other and larger formats.

The embodiments of the invention will now be described in more detail with reference to the accompanying schematic drawings which by way of example illustrate embodiments of the invention according to its different aspects.

DESCRIPTION OF EMBODIMENTS OF THE INVENTION

Figure 4A:
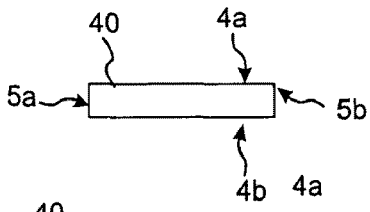
FIGS. 4*a-e* show a flooring according to an embodiment of the invention.
Figure 4B:
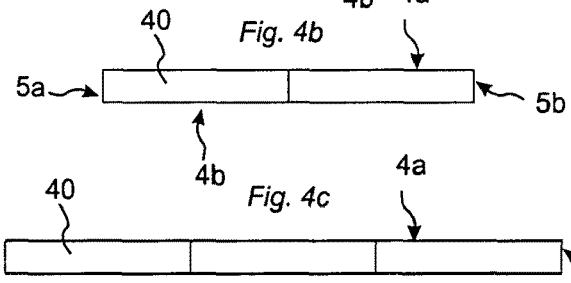
Figure 4C:
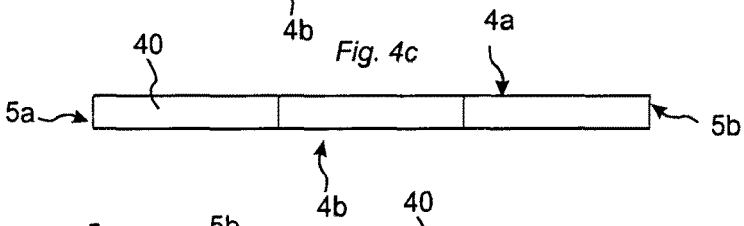

FIGS. 4*a-c* illustrate floorboards 1, 1=whose long sides 4*a*, 4*b* and short sides 5*a*, 5*b* are provided with mechanical locking systems. The vertical locking means may comprise, for example, a tongue groove 23 and a tongue 22 (see FIG. 5*a*). The horizontal locking means may comprise locking elements 8 which cooperate with locking grooves 14. All floorboards are rectangular and have a width corresponding to a traditional parquet block. Thus the width is about one third of a traditional laminate floorboard. In FIG. 4*a*, the surface of the floorboard has the shape of a parquet block. In FIG. 4*b*, the surface has a decorative surface layer consisting of two parquet blocks, and in FIG. 4*c* the surface layer consists of three parquet blocks. The surface layer can be laminate, wood, plastic, linoleum, cork, various fiber materials such as needle felt and the like. The surface can also be printed and/or varnished.

Figure 4D:
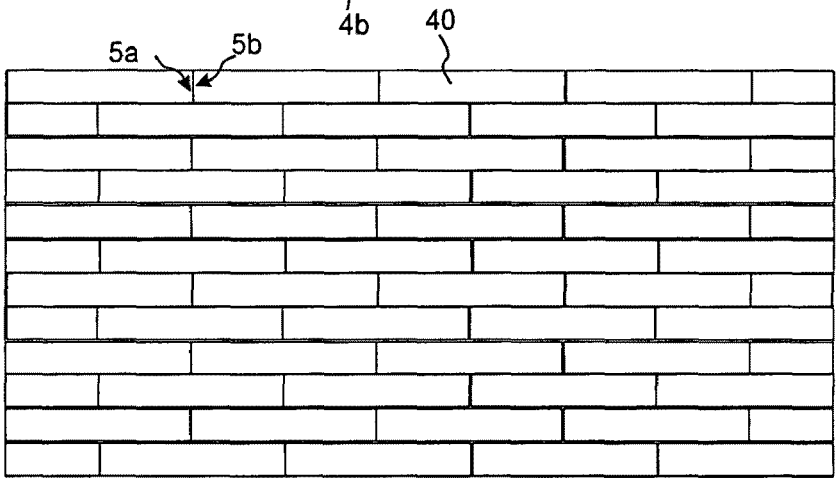
Figure 4E:
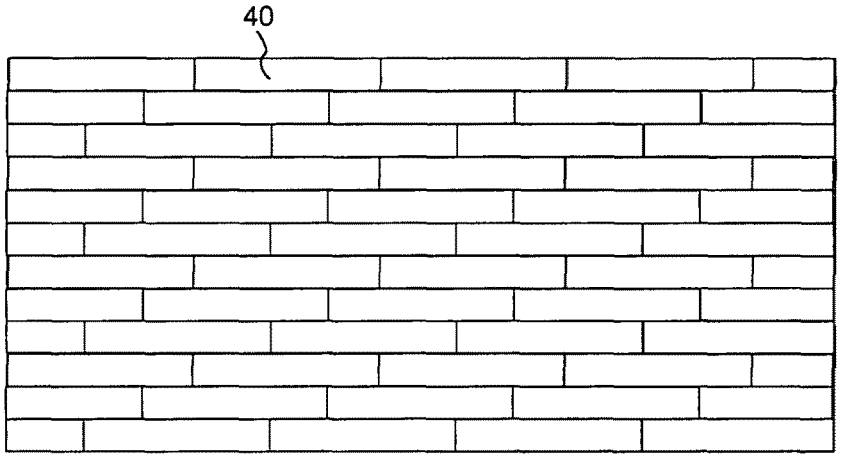

FIG. 4*d* shows that such floorboards, which may thus comprise one or more blocks, can be joined to a flooring which in a natural way forms a brick-bond pattern. All blocks, except those at the outer portions of the floorboard, may have a full length. If the floorboard comprises more than one block (FIGS. 4*b, c*) a certain pattern alignment must take place in the production. On the other hand, if the floorboard comprises a single block according to FIG. 4*a*, no such pattern alignment is necessary. The floorboard can be made by sawing a floor element, which only has a pattern consisting of, for instance, veneer with varying shades so as to resemble wood blocks that are made from different logs of the same kind of wood. In the flooring according to FIG. 4*d*, the blocks are displaced a distance corresponding to half their length. FIG. 4*e* shows an example of a displacement by one third of the length.

Figure 5A:
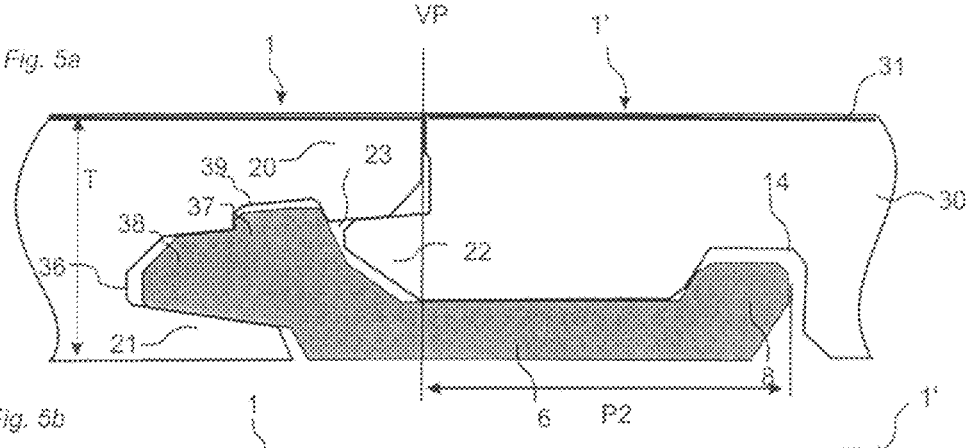
FIGS. 5*a-d* show a joint system according to an embodiment of the invention.

FIGS. 5*a-d* show that the waste can be reduced to essentially the waste that arises in connection with sawing if the joint system is formed with a separate strip 6 which is mechanically fixed by a tongue 38 cooperating with a tongue groove 36. Fixing can take place by snapping into the joint edge of the floorboard 1 in such a manner that the upper lip 20 and the lower lip 21 are bent upwards and downwards respectively, when the strip 6 is inserted towards the tongue groove 36 of the floor-board 1. The locking element 37 cooperates with the locking groove 39. Joining of the strip 6 with the tongue groove 36 can take place in many alternative ways. For instance, the locking groove 39 can be formed in the lower lip 21 and the locking element 37 can be formed in the lower front part of the strip 6 so as to cooperate with the locking groove 39. Joining of the strip 6 with the joint edge of the floorboard can also take place by inward angling of the strip 6 or snapping-in of the strip 6 in any upwardly angled position. This locking system allows cost-efficient manufacture of narrow floorboards without much waste. FIG. 5*a* shows an example of a laminate floorboard 1, 1=with a wood fiber core 30 and a surface layer 31 of laminate. In this embodiment the separate strip 6 consists of wood fibers. The material of the wood fiber based strip 6 could be solid wood, plywood, particle board, fiberboard such as MDF, HDF, compact laminate made of wood fibers impregnated with thermosetting resin, or similar materials. FIGS. 5*a, b* show a locking system which can be locked by inward angling and snapping-in, and FIGS. 5*c, d* illustrate a locking system which can locked by snapping-in. The projecting portion P2 of the strip 6 which extends beyond the upper part of the join edges may in this embodiment be equal or larger than the floor thickness T. This facilitates locking with angling around the upper part of the joint edges. A locking system which allows locking and unlocking by angling and which consists of a separate strip is especially favorable on the long side of a narrow floorboard.

Figures 6A, 6B, 6C, 6D:
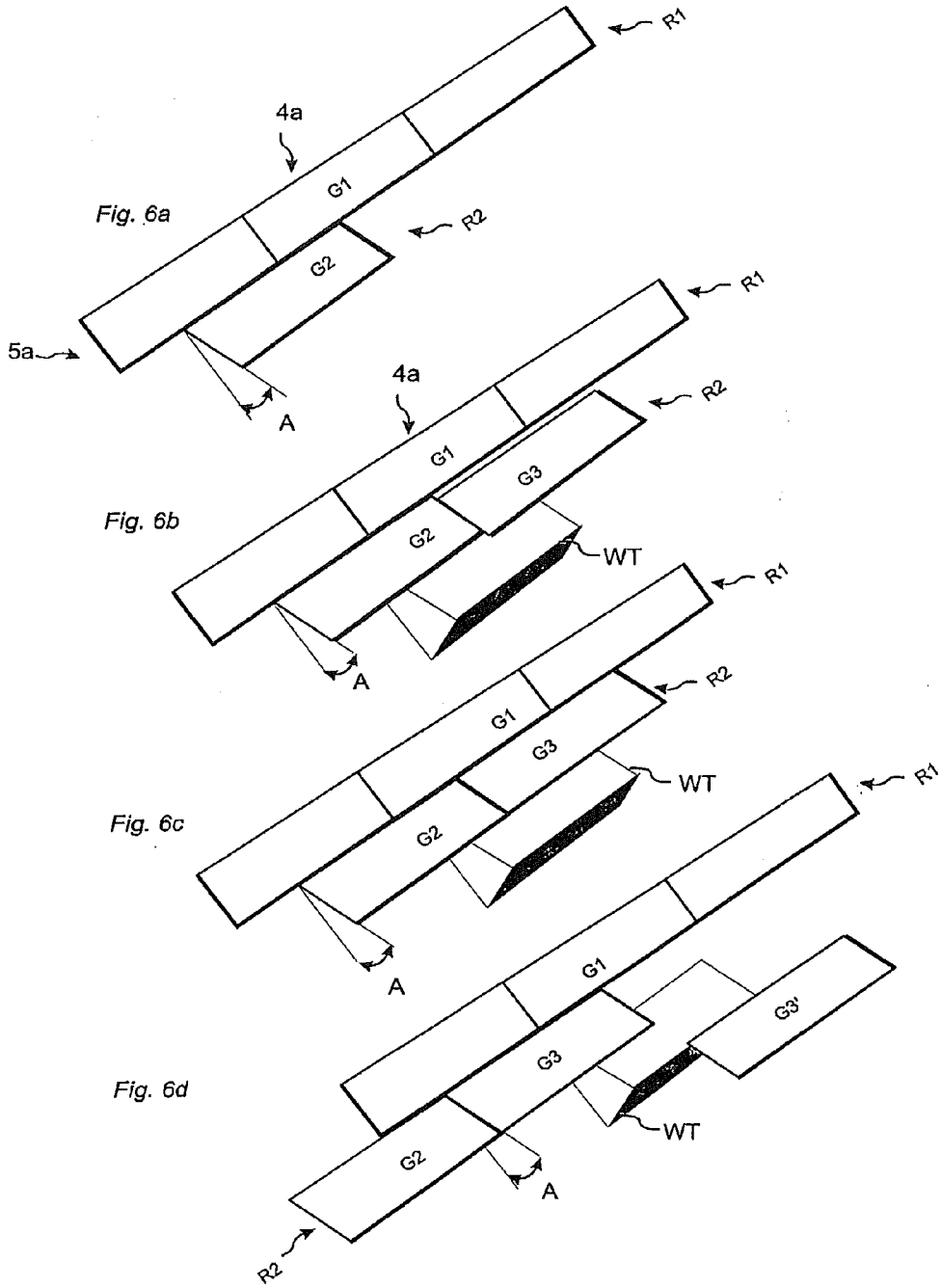
FIGS. 6*a-d* show a laying method according to an embodiment of the invention.
Figures 7A, 7B, 7C, 7D, 7E:
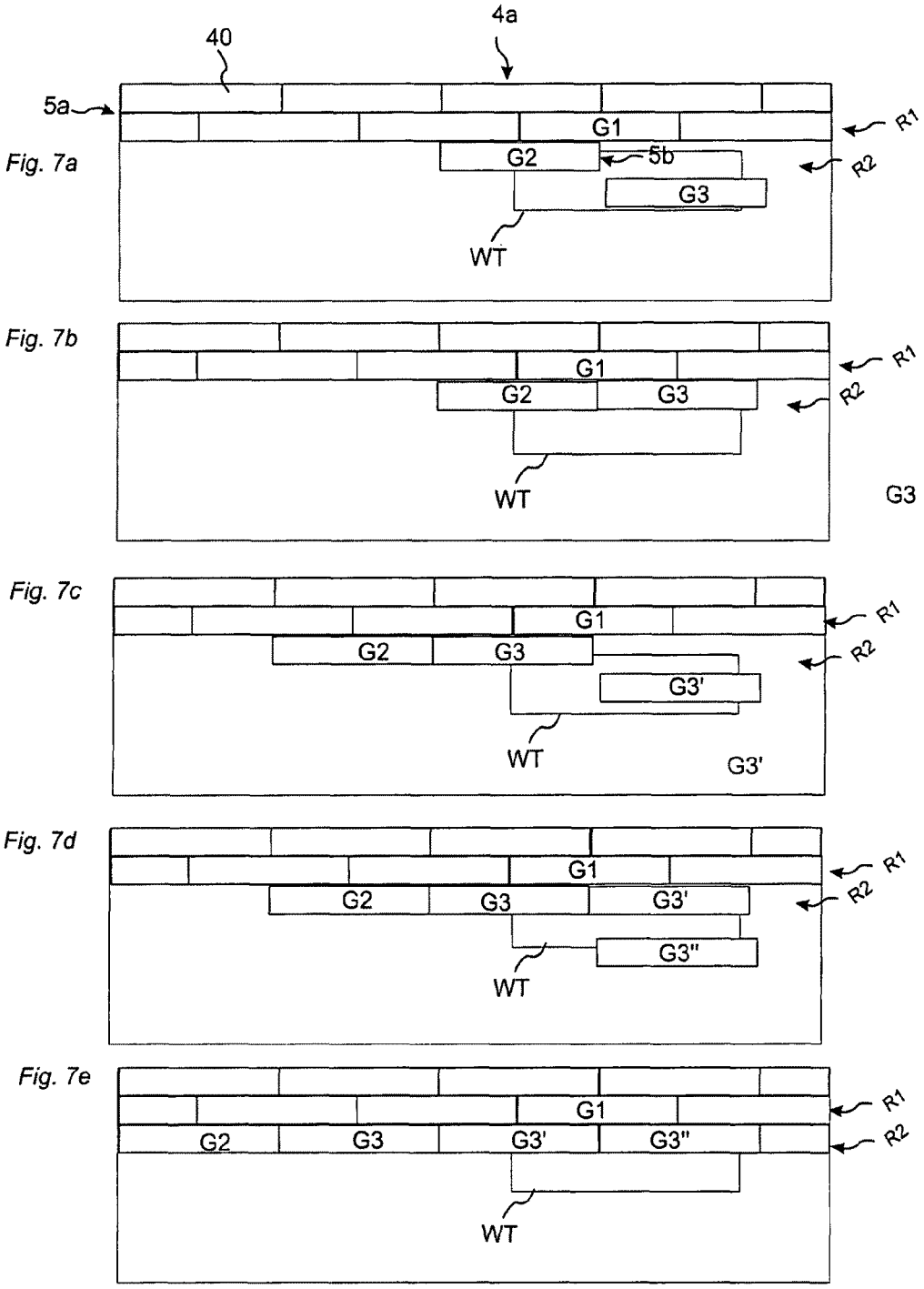
FIGS. 7*a-e* show a laying method according to an embodiment of the present invention.

FIGS. 6*a*-6*d* illustrate a laying procedure. The floorboards are rectangular and can be joined mechanically. The laying operation begins, for example, with a first row R1 being joined by, for example, the short sides of the floorboards being angled together. The first row, which may in fact be an optional row in the floor, contains a floorboard G1 which is called the first board. A second floorboard G2, in a second row R2 (FIG. 6*a*), is arranged at an angle A to the first floorboard G1 and is with its upper joint edge in contact with the joint edge of the first floorboard G1. FIG. 6*b* shows that the laying may be facilitated if a wedge-shaped tool WT is used as a support. A new floorboard G3 in a second row R2 is then locked together with its short side against the short side of the second floorboard G2 in the second row. This joining of short sides can take place by insertion along the joint edge of the short side, by inward angling or snapping-in against the joint edge of the short side. During inward angling and preferably also during snapping-in, this joining is carried out in such a manner that the upper joint edge of the new floorboard G3 is positioned at a distance from the upper joint edge of the first floorboard G1. During insertion along the joint edge of the short side, this is not necessary since the new board G3 can be inserted so as to contact the first board. The new board G3 can also first be joined with the first G1 by snap action, after which it is laterally displaced along the long side so that the short side is snapped in against the short side of the second floorboard G2. Then both the new G3 and the second floorboard G2 are laterally displaced (FIG. 6*c*) along their long sides parallel to the first floorboard G1. The first lateral displacement may be essentially equal to the length 4*a* of the floorboard. A further new floorboard G3=may then be joined according to FIG. 6*d*. When essentially the entire row R2 has been filled, all floorboards are angled downward and locked. Essentially the entire installation can take place in this way.

Figure 5B:
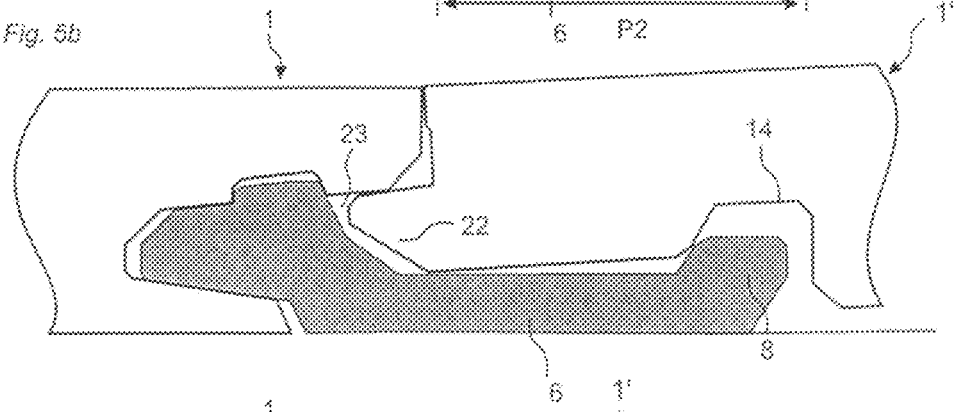
Figure 5C:
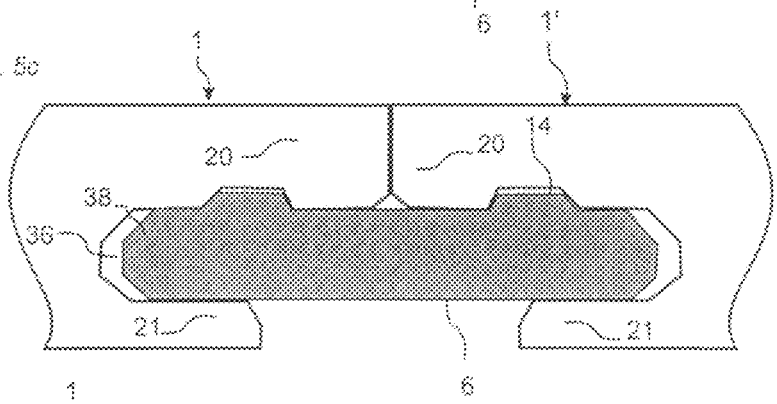
Figure 5D:
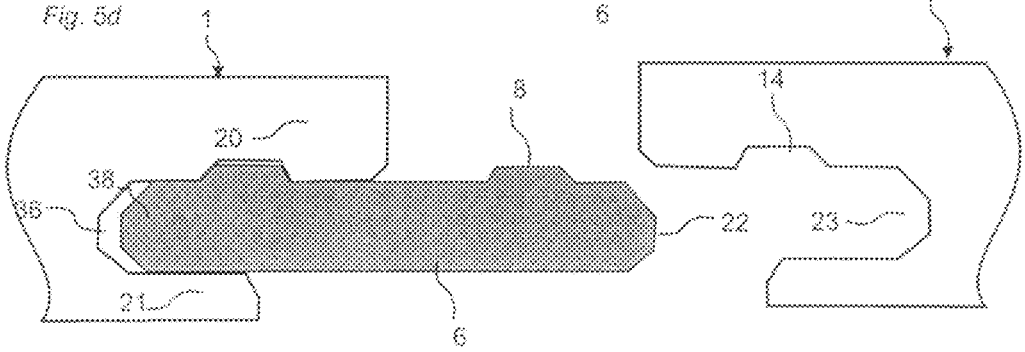

FIGS. 7*a*-7*e* show the same laying seen from above. When a new board G3, G3' and G3" after angling is displaced, the second row R2 grows. This laying may be repeated until the second floorboard G2 reaches the outer part of the floor according to FIG. 7*d*. The main advantage is that the entire row R2 can be laid without a floor-layer needing to move along the floor rows. Owing to the weight and flexibility of the floorboards, the different upwardly angled floorboards will take different angles. They may easily slide in a semi-locked state. This is shown in FIG. 5*b*. The locking means 22, 23 and 8, 14 are not fully locked and this reduces friction while at the same time the boards 1, 1=are prevented from sliding apart by the locking element 8 being partly inserted into the locking groove 14.

This method of laying is particularly suited for small floorboards, but may also be used in larger. The laying method renders it possible to automate laying. Another advantage is that this laying method allows automated laying by means of a laying device. According to the invention, which thus also comprises a laying device for floorboards, the floorboards can be laid using a suitable device which, for instance, consists of the following parts and functions. The device has a store containing a number of new floorboards G3, G3' etc. These floorboards are, for instance, stacked on each other. It has a first inserting device which first inserts the new board G3, at an angle to the first board G1 in the first row R1. The inserting motion takes place along the short sides so that the short sides of the second G2 and the new G3 board will be mechanically locked. The device further comprises a second inserting device which displaces the two joined boards laterally parallel to the first row R1. When the device is moved from the first row R1, all boards which have not yet reached a position parallel to the sub-floor will finally be angled down towards the sub-floor.

Figure 1A:
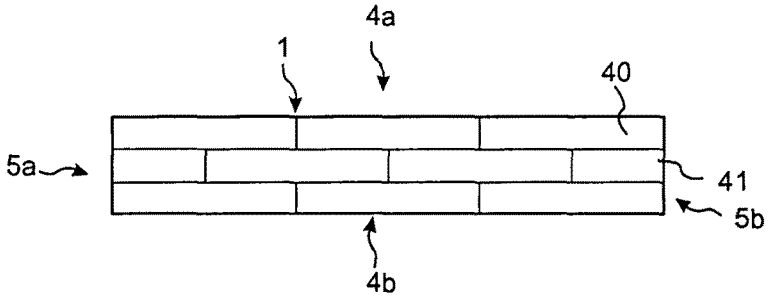
FIGS. 1*a-c* illustrate prior-art floorboards.
Figure 1B:
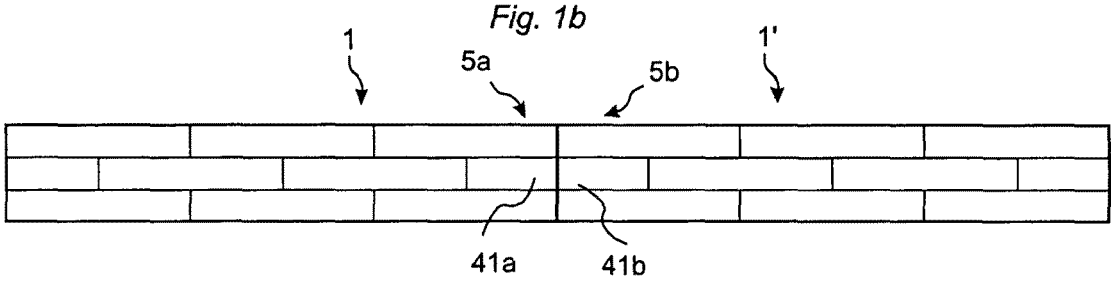
Figure 1C:
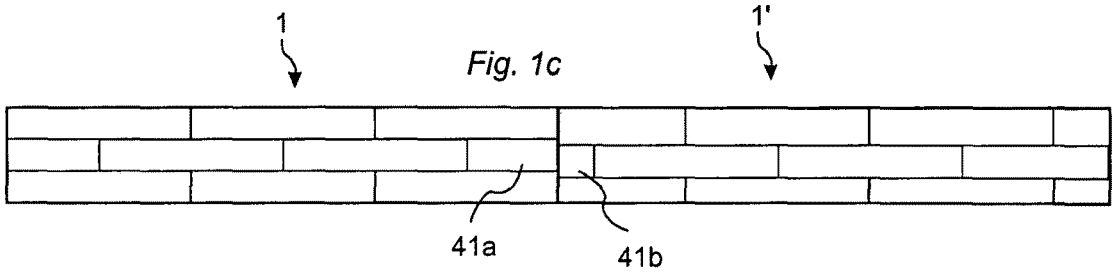
Figure 2:
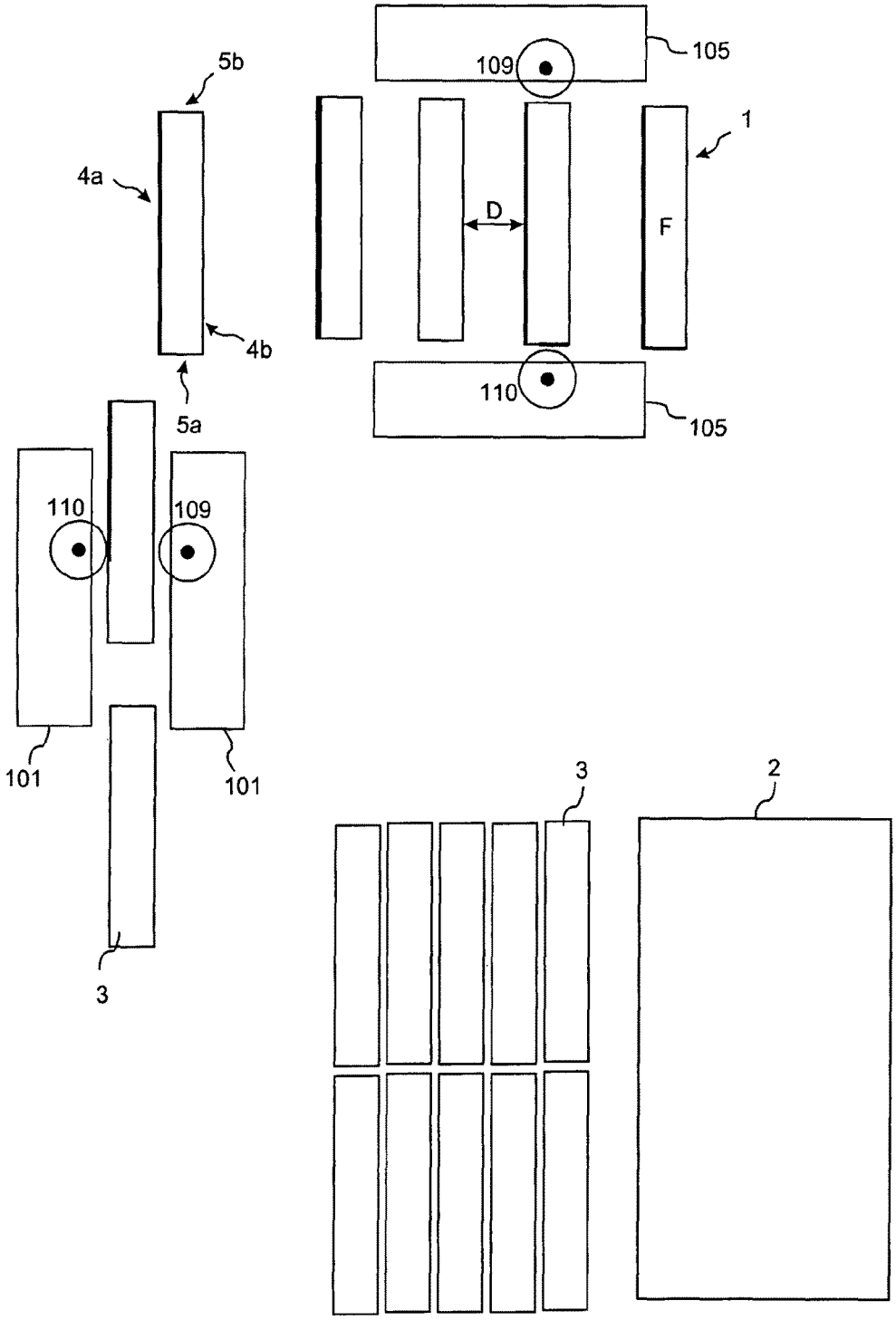
FIG. 2 shows manufacture of laminate flooring according to prior-art technique.
Figure 3A:
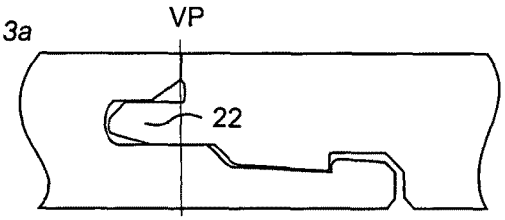
FIGS. 3*a-f* show examples of known mechanical locking systems.
Figure 3B:
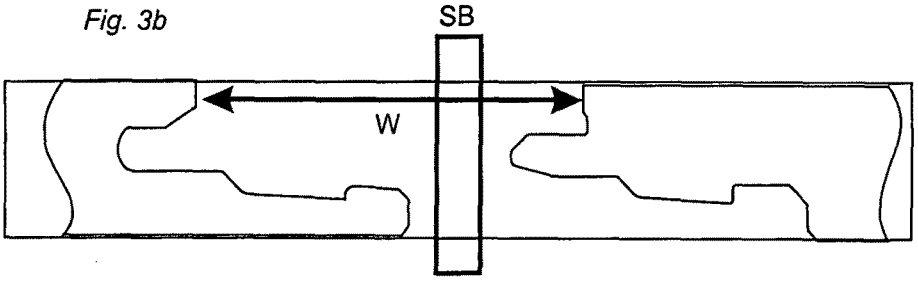
Figure 3C:
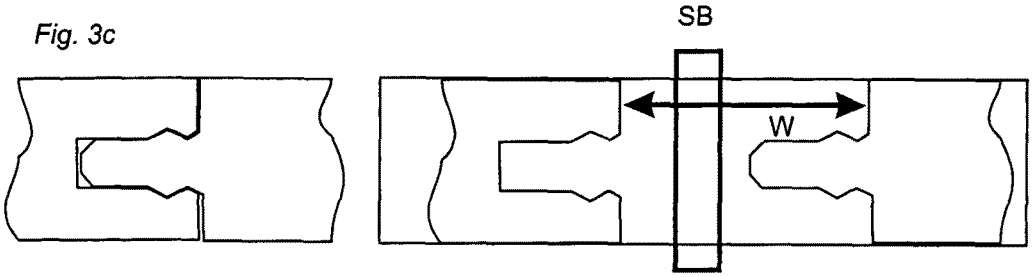
Figure 3D:
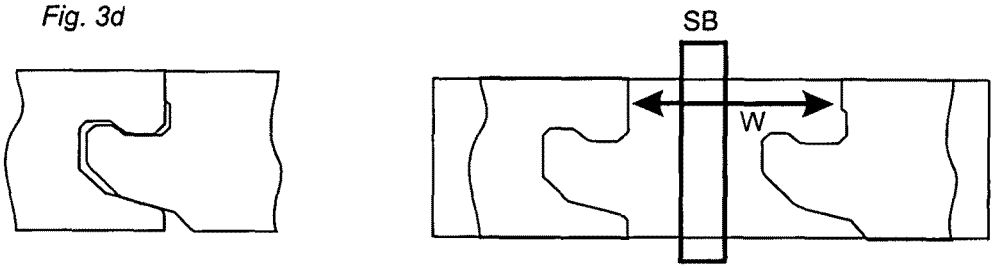
Figure 3E:
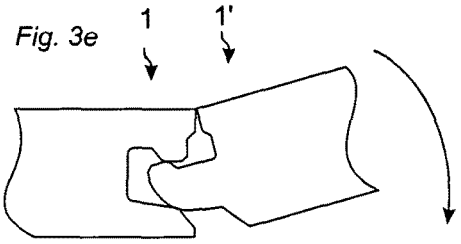
Figure 3F:
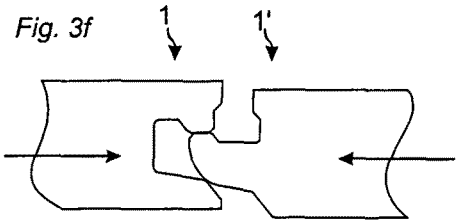
Figure 8:
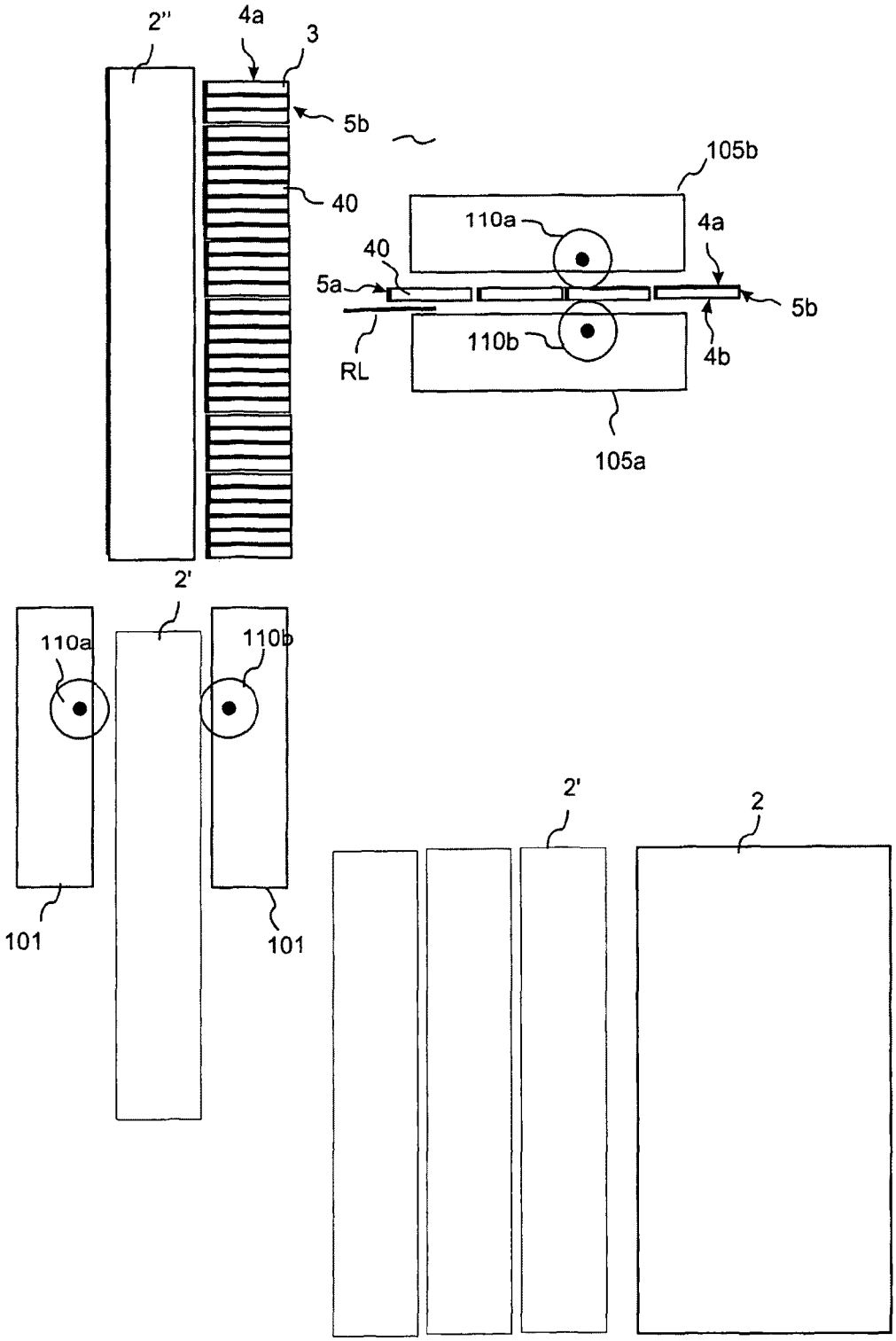
FIG. 8 illustrates a manufacturing method for manufacturing floorboards according to an embodiment of the invention.

FIG. 8 shows a method for manufacturing a flooring with mechanical joint systems. The floor element 2 is sawn into new floor elements 2'. These floor elements are then machined along their long sides, e.g. in a machine with two chains. In this manner, a semimanufactured product in the form of a short side panel 2" is manufactured. This machining, which thus is a rational machining of the long sides of the floor element, in fact forms the short sides 5*a*, 5*b* of the floorboards. After this first machining, the short side panel 2" is sawn into floor panels 3, the edges of which are then machined along the long sides 4*a*, 4*b*, e.g. in a machine with only one chain. The method is based on the fact that manufacture, contrary to today's manufacture, takes place by the long sides being machined last and a special sawing or dividing operation taking place between machining of the short side of the floorboard and machining of its long side. The method thus implies that the short sides can be manufactured in a large format very rationally even if the floorboards are narrow. Today=s machines operate with a lower capacity since machining of short sides takes place by means of cams on chains and this means that the boards are machined with a distance that in FIG. 2 is designated D. The risk of angular errors between long side and short side can be significantly smaller than in traditional manufacture. Any lateral crookedness that may arise in connection with sawing into floor panels can be eliminated by the boards being aligned with a ruler RL before the machining of the long sides.

If the floorboard has a width of 85 mm and a length of 6*85=510 mm, the machining of the long sides will require a machining time which is six times longer than the machining of the short sides. An efficient production line may consist of a short side machine and a sawing unit and a plurality of long side machines, for instance six.

Mirror-inverted locking systems can be provided by, for instance, the short side panel 2" before sawing being rotated in the horizontal plane through 180 degrees. Alternatively, the floor panel 3 can be rotated correspondingly after sawing.

Machining of long sides and short sides may take place in one and the same machine and using the same set of tools. Several variants are feasible. For instance, the long sides may be machined first. The floor element then has a length corresponding to several floorboards and a width corresponding to one floorboard. After the first machining, the floor element is divided into several floor panels, the edges of which are then machined along the short sides.

FIGS. 9*a*-9*e* show a floor system which consists of two different board formats with mirror-inverted mechanical locking systems which can be joined by inward angling on long sides and short sides.

Figure 9A:
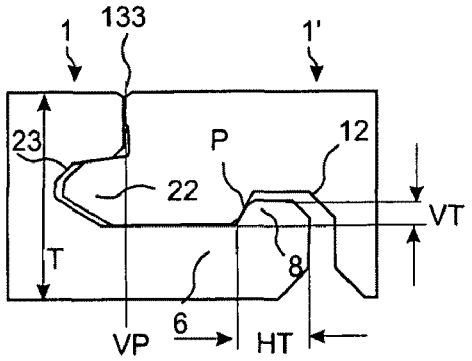
FIGS. 9*a-f* show a floor system according to an embodiment of the invention.

FIG. 9*a* shows a locking system which in this embodiment is made integrally in one piece with the core of the floorboard and which is so designed that a long side can be joined with a short side. The vertical locking is obtained by a tongue 22 and a groove 23. The horizontal locking is accomplished with a strip and a locking element 8 on one of the floorboards 1 cooperating with a locking groove 12 on the other floorboard 1'. It is an advantage if the locking system is essentially identical on both long side and short side. In this embodiment, the locking system is identical. However, it should be pointed out that the invention can also be applied to floorboards with different locking systems and/or locking systems containing separate or different materials than the core. Such differences can exist between different floorboards and/or long side and short side. The locking system can be joined by inward angling. In this embodiment, the locking system withstands a high tensile load corresponding to about 100 kg in a locking system having an extent along the joint edge of 100 mm. The locking element 8 has a considerable extent vertically VT and horizontally HT. In this embodiment, the vertical extent VT is 0.1 times the floor thickness T and the horizontal HT 0.3 times the floor thickness T.

Figure 9F:
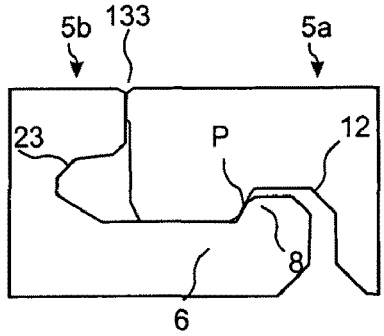
Figure 9B:
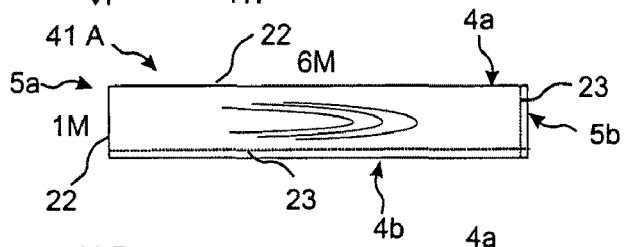
Figure 9C:
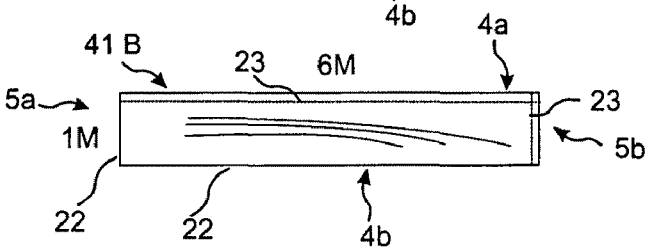

FIG. 9*b* shows a floorboard 41A having a width 1M and a length 6M which is 6 times the width. It may be an advantage if the dimensional accuracy can be less than 0.1 mm and maybe even within the tolerance of 0.05 mm or lower. With modern machines, it is possible to achieve tolerances of 0.02 mm. FIG. 9*c* shows an identical floorboard 41B, with the difference that the locking system is mirror-inverted. 41A and 41B have short sides with the same tongue side 22 and groove side 23. The long side of the floorboard 41A has a tongue side 22 on the side where the floorboard 42B has a groove side. Thus the locking systems are mirror-inverted.

Such a flooring system allows laying in advanced patterns since long sides can be joined with short sides and the direction of laying can be varied. The module system with the length as an exact multiple of the width increases the possibilities of variation.

Figure 9D:
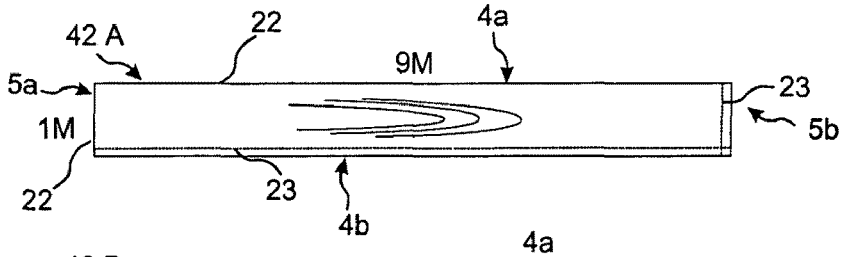
Figure 9E:
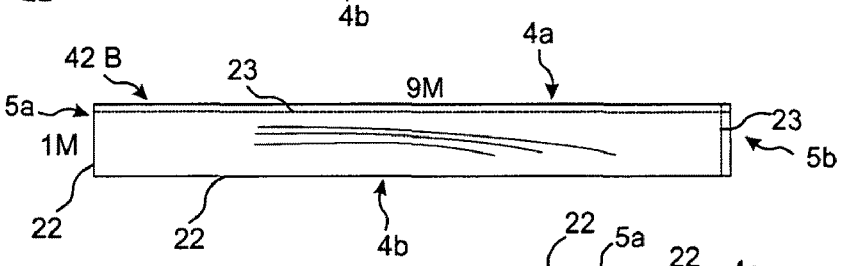

FIGS. 9*d* and 9*e* show corresponding floorboards with a length 9M which in this embodiment is, for instance, 9 times the width 1M. Moreover, if the floor system consists of boards with different lengths, still more advanced patterns can be provided.

It is obvious that a number of variants are feasible within the scope of the above principles. FIG. 9*f* shows two short sides 5*a* and 5*b* of two adjacent edges of floorboards. In this embodiment there is only a horizontal locking consisting of a strip 6, locking element 8 and a locking groove 12. Such floorboards could have a locking system on long sides as shown in FIG. 5*a* and they could be installed in parallel rows. If the floorboards have mirror inverted locking system as described above, they could be installed in a herringbone pattern long side to short side. Floorboards can be made in many varying lengths and widths. The floor system may consist of three floorboards or more with different sizes and the floorboards may have the same width but random lengths. Some floorboards can have the width measure 1M and others 2M or more. Nor do the floorboards have to have parallel sides. For instance, the short sides can be made at an angle of 45 degrees to the long sides. Such manufacture can be carried out rationally in a machine with two chains where the cams of the chains are displaced so that the boards will pass the milling tools at an angle of, e.g., 45 degrees. Also other optional angles can be made in this manner.

Figure 10:
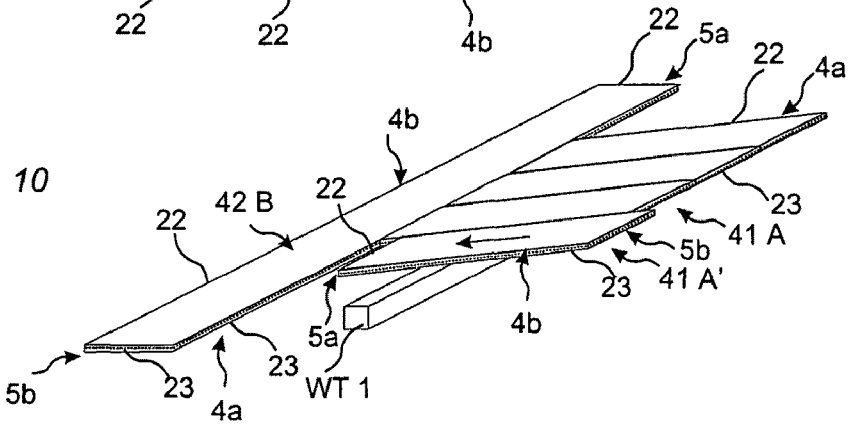
FIG. 10 shows laying of floorboards according to an embodiment of the invention.

FIG. 10 shows examples of how floorboards 41A can be joined by inward angling long side against short side with an already laid floorboard 42B. According to the invention, the long sides of the floorboards 41A are joined by inward angling. Such a floorboard, referred to as second floorboard 41A, is in the initial phase of the laying in an upwardly angled position relative to a first, previously laid floorboard 42B in the first row. A short side of this second floorboard 41A is in contact with the long side of the already laid first floorboard 42B. It is an advantage if a support WT is used to hold this and the already laid floorboards in the second row in an upwardly angled position. A new floorboard 41A' is angled with its long side against the second floorboard 41A in the second row which is perpendicular to the first laid floorboard 42B. The new floorboard 41A which is locked to the second floorboard 41A is then displaced along the joint edge in the locked position until its upper short side edge comes into contact with the long side edge of the first board 42B. Subsequently, the entire second row of floorboards 41A, 41A' is angled down towards the sub-floor. If a suitable laying order is applied, advanced patterns can be laid with this angle-angle method. The joint system obtains great strength and large floors can be laid without expansion joints between floor sections.

Figure 11A:
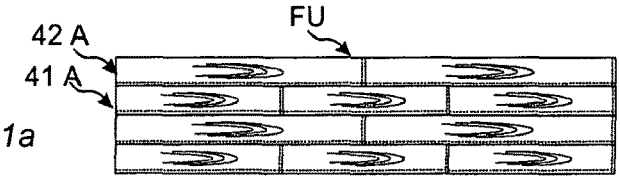
FIGS. 11*a*-16*e* show examples of different patterns and laying methods according to embodiments of the invention.

FIG. 11*a* shows how floorboards 41A and 42A of different lengths can be combined to a floor unit FU in a floor system so that all rows will be of the same length and the entire floor unit FU will have a locking system on all sides.

Figure 11B:
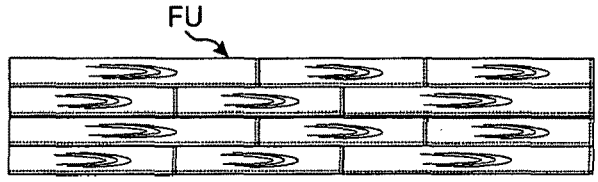
Figure 11C:
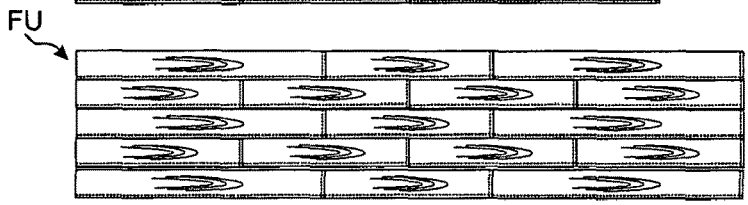

FIGS. 11*b* and 11*c* show how the length of the floor unit FU can be varied by combining the boards of different lengths. The length of the floor unit can be changed in steps which are half the length of the shortest board. The width can be varied by the number of rows according to FIG. 11*c*.

Figure 12A:
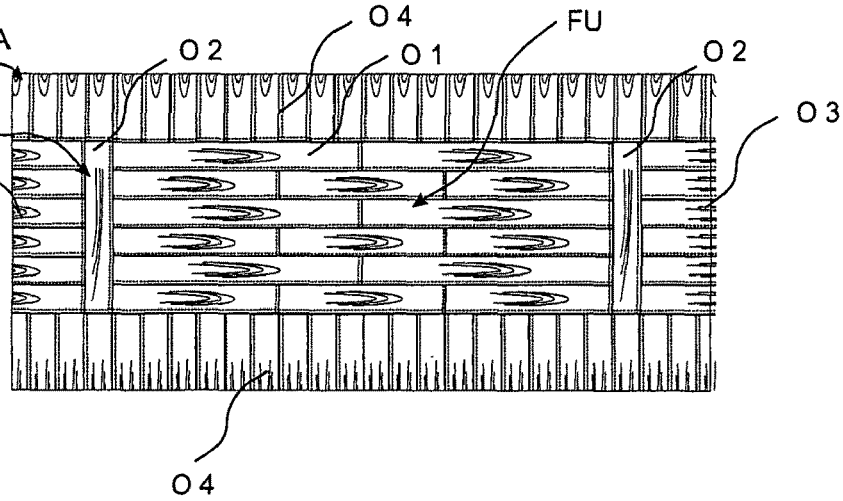

FIG. 12*a* shows that the floor unit FU can be adjusted to the size of the room so that a decorative frame of sawn boards 41*a* can be formed, which can be used to make the final adaptation of the floor to the size of the room. To create the decorative pattern, floorboards with mirror-inverted locking systems 41A and 41B are used. 01-04 indicate a laying order which can be used to join the floorboards using the angleBangle method. After installing the floor unit FU in parallel rows with boards of different lengths, a mirror-inverted board 41B is joined with the short sides of the floor unit O2. This board has a length which in that alternative corresponds to the width of six floorboards. Then the vertical rows O3 are joined by the angle-angle method and finally the laying of the floor is terminated by the horizontal rows O4 also being locked in the same way.

This and other patterns can, of course, also be joined by the combination of angling, displacement and snapping, or merely snapping, displacement and snapping. Also insertion along the joint edge can be used. A locking system on short sides without a tongue as shown in FIG. 9*f* allows installation with only angling of the long sides.

Figure 12B:
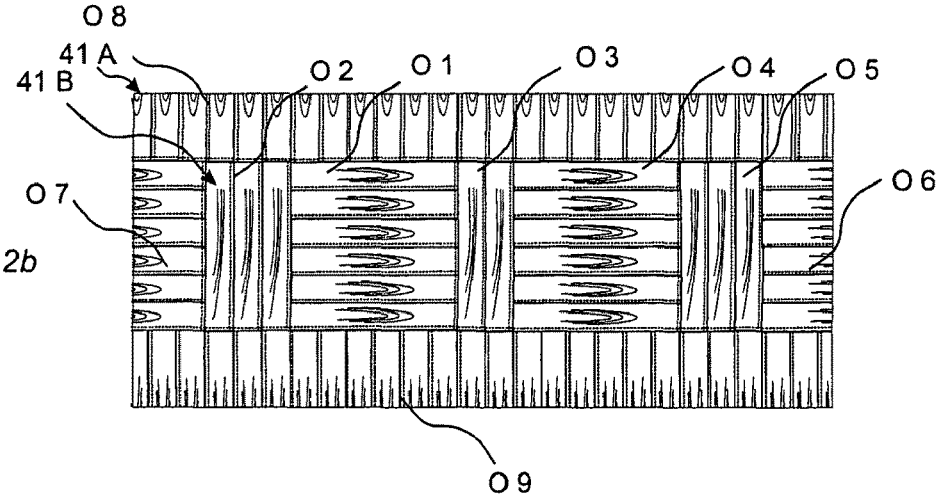

FIG. 12*b* shows a variant which in this embodiment comprises a plurality of mirror-inverted boards 41B. The laying can be effected in the same way as above, for instance according to the laying order O1-O9.

One condition for the above laying of the floor to be done with high quality without large visible joint gaps is that the floorboards are manufactured with great dimensional accuracy. It is advantageous if each joint can be given a certain degree of flexibility so that the manufacturing tolerances are balanced. A play P between the locking surfaces of the locking element 8 and the locking groove 12 of, e.g., 0.05 mm, as shown in FIGS. 9*a* and 9*f*, is advantageous in this context. Such a play P does not cause a visible joint gap. Beveling 133 of upper joint edges can also be used to conceal a joint gap and also to remove parts of the hard surface layer so that the upper joint edges will be more flexible and can be compressed.

Figure 13A:
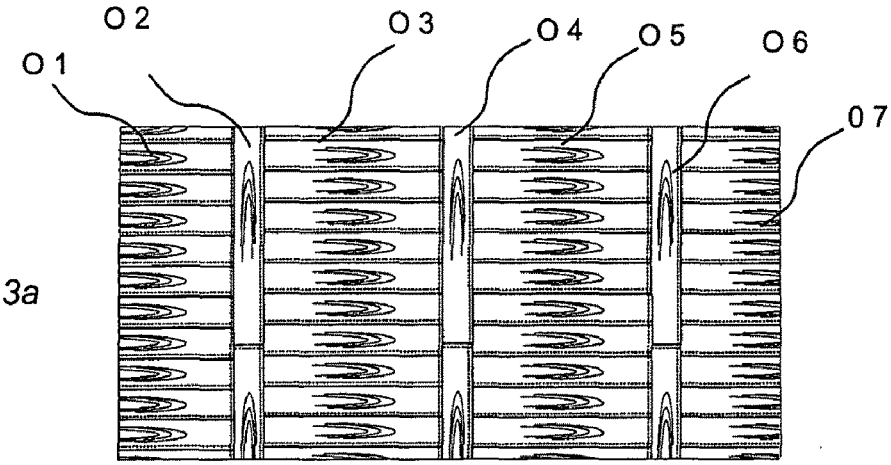

FIG. 13*a* shows another pattern which can be laid according to the angle-angle method in the order O1-O7. The pattern can be created with only one type of boards which need not have mirror-inverted joint systems.

Figure 14A:
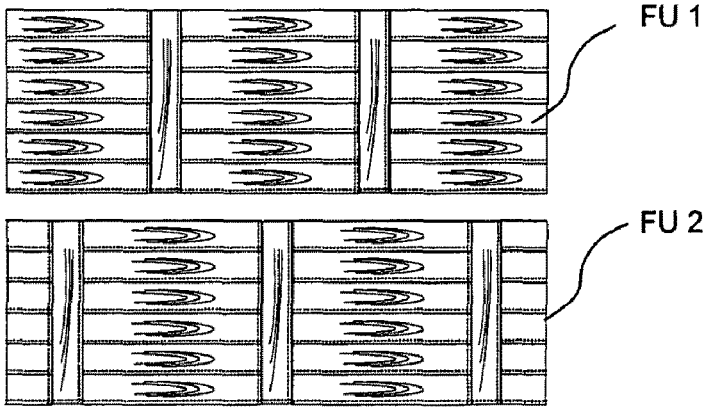
Figure 14B:
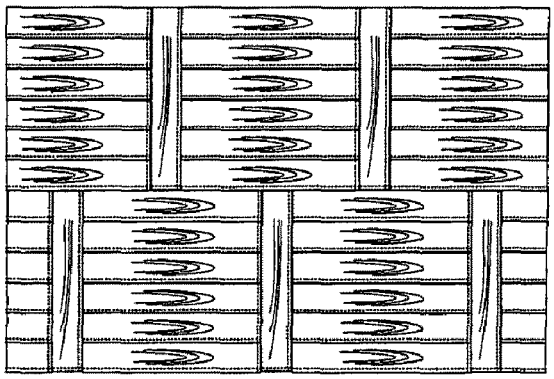

FIGS. 14*a*-*b* show a diamond pattern with offset diamonds that can be laid by first joining floorboards to two floor units FU 1 and FU 2. Then these two floor units are joined with each other by, for instance, inward angling.

Figure 15A:
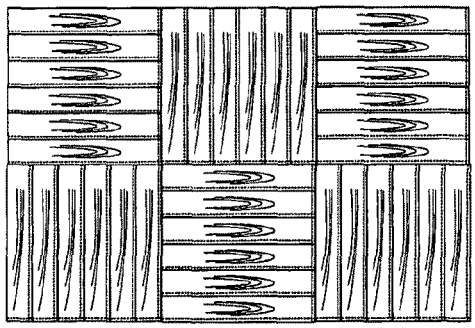
Figure 15B:
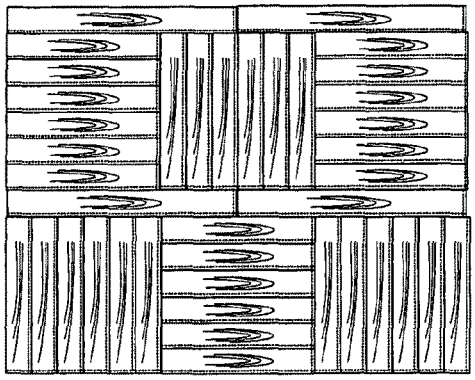
Figure 15C:
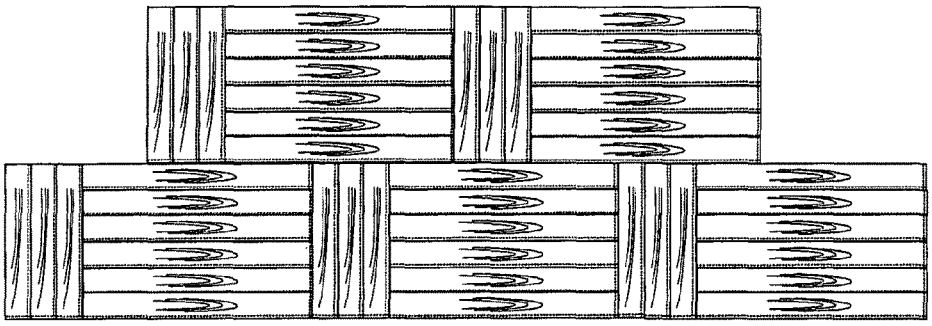

FIGS. 15*a*-*c* show alternative patterns which can be created with a floor system and laying methods as described above.

Figure 16A:
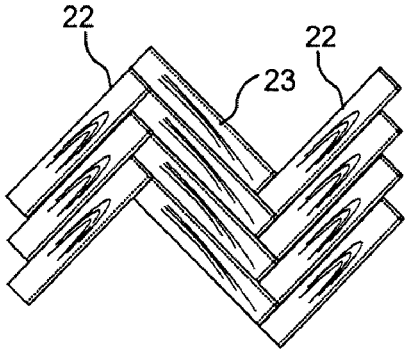
Figure 16B:
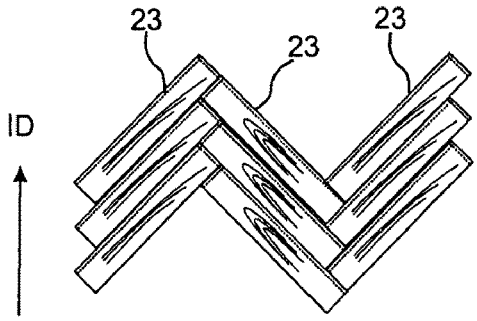

FIGS. 16*a*-*b* show herringbone patterns which can be joined by the long sides being angled inwards and the short side being snapped against the long side. Laying can be carried out in many different ways for example with only angling of long sides. In FIG. 16, the floor is laid with both groove side 23 and tongue side 22 in the laying direction ID. It is still more convenient if laying takes place with merely the groove side 23 in the laying direction according to FIG. 16*b*.

Figure 16C:
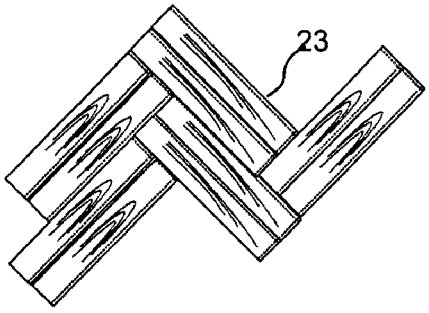
Figure 16D:
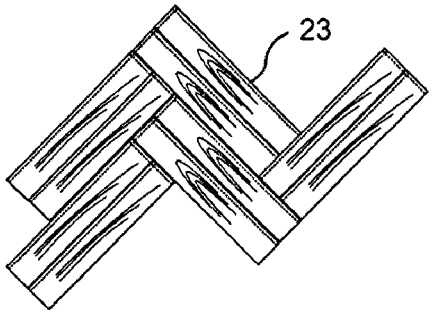
Figure 16E:
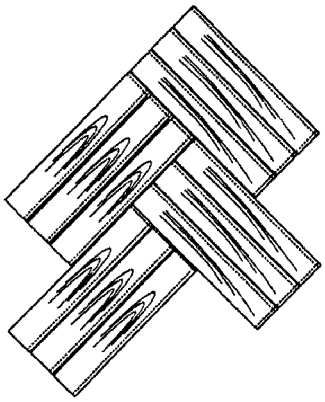

FIGS. 16*c*-*e* show herringbone patterns with two and three blocks.

Figure 17A:
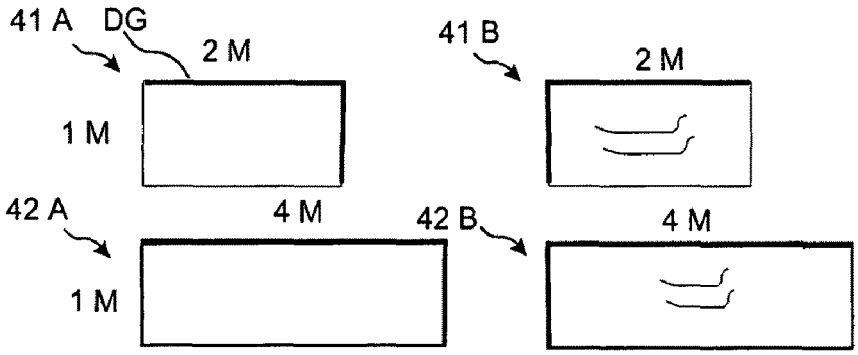
FIGS. 17*a*-17*c* show examples of floor systems with floorboards according to embodiments of the invention in formats and laying patterns that are convenient to resemble a stone floor.
Figure 17B:
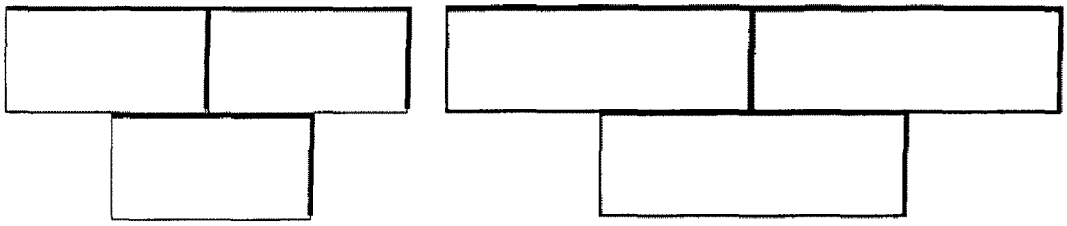
Figure 17C:
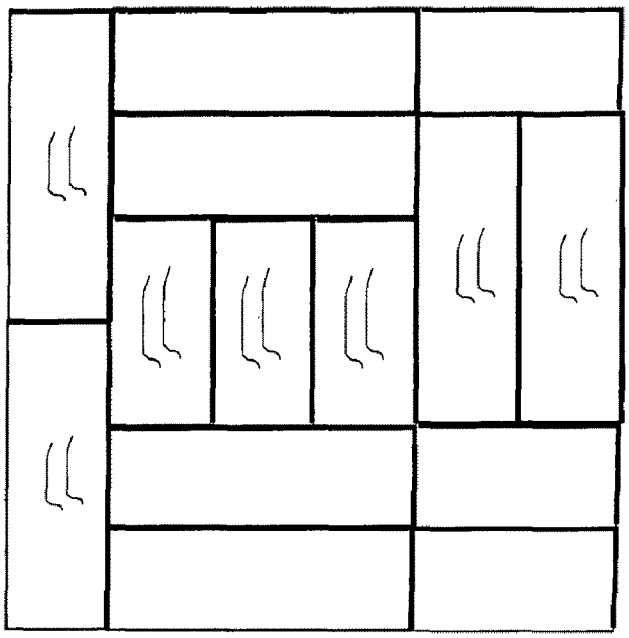

FIGS. 17*a*-*c* show how the corresponding patterns can be created with floorboards having a format which, for instance, resembles stone. The floorboards have a decorative groove DG on one long side and one short side which is made, for example, by part of the outer decorative layer being removed so that other parts of the surface layer that are positioned under the decorative layer, or the core, become visible.

FIG. 17*c* shows how mirror-inverted floorboards can be joined in advanced patterns where the decorative groove after installation frames the floorboards.

It is noted that the invention may be applied to even smaller boards, blocks or strips than those described above. Such strips may, e.g., have a width of 2 cm and a length of 10 cm. The invention may also be used to produce very narrow floor panels, for instance of about 1 cm or less, which could be used to connect different floor units or as decoration.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A flooring, which comprises rectangular floor-boards for providing a patterned floating flooring, said floorboards comprising:

first and second opposing long edges, and first and second connectors extend along the long edges for locking together one floorboard with a second floorboard, such that upper edge portions of said one floorboard and said second floorboard, in a joined state, together define a vertical plane, whereby said first connectors comprise an upwardly projecting locking element on one of the long edges cooperating with a locking groove on the other of the long edges of the second floorboard for locking together said floorboard and said second floorboard in a horizontal plane, perpendicular to said vertical plane, and whereby said second connectors comprise a tongue and a groove for locking together said floorboard and said second floorboard in a vertical direction, perpendicular to a main plane of said floorboards, wherein the floorboard further includes first and second opposing short edges, the short edges of said floorboards having a length not exceeding 10 cm, and the short edges having a locking system comprising a locking element for horizontally locking of said floorboards to another floorboard, and wherein one of the first and second short edges does not have any portion thereof extending past the vertical plane so as to enable the short edges to be joined by vertical folding.

2. The flooring as claimed in claim 1, wherein the vertical extent of the locking element is 0.1 times the floor thickness and the horizontal extent of the locking element is 0.3 times the floor thickness.

3. The flooring as claimed in claim 1, wherein said connectors are adapted for locking together said one floorboard and said second floorboard at least by means of inward angling, such that when the long edge of the second floorboard is pressed against an upper part of the long edge of the one floorboard and is then angled down, the locking element can enter the locking groove.

4. The flooring as claimed in claim 3, wherein said locking system at the short edge are adapted for locking together said one floorboard and said second floorboard by means of inward angling and displacement along the short edge.

5. The flooring as claimed in claim 1, wherein said connectors are adapted for releasing said one floorboard and said second floorboard by means of upward angling, away from a sub-floor.

6. The flooring as claimed in claim 1, wherein said second floorboard is substantially identical with said one floorboard.

7. The flooring as claimed in claim 1, wherein said one floorboard has a surface layer comprising a thermosetting resin.

8. A rectangular floorboard for providing a patterned floating flooring in accordance with claim 1.

9. The flooring as claimed in claim 1, wherein the short edge locking element has a vertical extent and a horizontal extent that fits within a locking groove, and the combined vertical and horizontal extent is adapted to withstand a tensile load of about 100 kg or more.

10. A flooring, which comprises rectangular floor-boards for providing a patterned floating flooring, said floorboards being provided, along opposing long edges, with integrated first and second connectors for locking together one floorboard with a second floorboard, such that upper edge portions of said one floorboard and said second floorboard, in a joined state, together define a vertical plane, whereby said first connectors comprise an upwardly projecting locking element on one long side cooperating with a locking groove on the other long side of the second floorboard for locking together said floorboard and said second floorboard in a horizontal plane, perpendicular to said vertical plane, and whereby said second connectors comprise a tongue and a groove for locking together said one floorboard and said second floorboard in a vertical direction, perpendicular to a main plane of said floorboards, with first and second opposing short edges having a locking system comprising a locking element for horizontally locking of said one floorboard to another floorboard and wherein one of the first and second short edges does not have any portion thereof extending past the vertical plane so as to enable the short edges to be joined by vertical folding, the short edge locking element has a vertical extent and a horizontal extent that fits within the locking groove, and the vertical extent is 0.1 times the floor thickness and the horizontal extent is 0.3 times the floor thickness.

11. The flooring as claimed in claim 1, wherein the long edges of said floorboards have a length not exceeding 80 cm.

12. The flooring as claimed in claim 1, wherein the short edge locking system only locks horizontally, and a vertical and a horizontal extent of the short edge locking element is adapted to withstand a tensile load of about 100 kg or more without vertical displacement of the short edge.

13. The flooring as claimed in claim 10, wherein the short edge locking element is adapted to withstand a tensile load of about 100 kg or more.

14. A flooring, which comprises rectangular floorboards for providing a patterned floating flooring, said comprising:

first and second opposing long edges, and first and second connectors extend along the long edges for locking together one floorboard with a second floorboard, such that upper edge portions of said floorboard and said second floorboard, in a joined state, together define a vertical plane, whereby said first connectors comprise an upwardly projecting locking element on one of the long edges cooperating with a locking groove on the other of the long edges of the second floorboard for locking together said floorboard and said second floorboard in a horizontal plane, perpendicular to said vertical plane, and whereby said second connectors comprise a tongue and a groove for locking together said floorboard and said second floorboard in a vertical direction, perpendicular to a main plane of said floorboards, wherein the floorboard further includes first and second opposing short edges, the short edges of said floorboards having a length not exceeding 10 cm, and the short edges do not include a locking system.

15. The flooring as claimed in claim 14, wherein the long edges of said floorboards have a length not exceeding 80 cm.

* * * * *

UNITED STATES PATENT AND TRADEMARK OFFICE

CERTIFICATE OF CORRECTION

PATENT NO. : 8,104,244 B2
APPLICATION NO. : 11/822717
DATED : January 31, 2012
INVENTOR(S) : Darko Pervan It is certified that error appears in the above-identified patent and that said Letters Patent is hereby corrected as shown below:

Column 18, lines 39-40, replace:

"14. A flooring, which comprises rectangular floorboards for providing a patterned floating flooring, said comprising:"

with

--14. A flooring, which comprises rectangular floorboards for providing a patterned floating flooring, said floorboards comprising:--.

Signed and Sealed this
Fourth Day of December, 2012

David J. Kappos

David J. Kappos
*Director of the United States Patent and Trademark Office*